US011732489B2

(12) United States Patent
Asakura

(10) Patent No.: US 11,732,489 B2
(45) Date of Patent: Aug. 22, 2023

(54) REBAR TYING MACHINE

(71) Applicant: MAKITA CORPORATION, Anjo (JP)

(72) Inventor: Yuta Asakura, Anjo (JP)

(73) Assignee: MAKITA CORPORATION, Anjo (JP)

( * ) Notice: Subject to any disclaimer, the term of this patent is extended or adjusted under 35 U.S.C. 154(b) by 17 days.

(21) Appl. No.: 17/345,622

(22) Filed: Jun. 11, 2021

(65) Prior Publication Data

US 2021/0404196 A1 Dec. 30, 2021

(30) Foreign Application Priority Data

Jun. 30, 2020 (JP) ..... 2020-112802

(51) Int. Cl.
*B21D 15/02* (2006.01)
*E04G 21/12* (2006.01)

(52) U.S. Cl.
CPC ..... *E04G 21/123* (2013.01)

(58) Field of Classification Search
CPC ..... B21F 15/02; B21F 15/04; E04G 21/122; E04G 21/123; B65B 13/025; B65B 13/185; B65B 13/28; B65B 13/285
See application file for complete search history.

(56) References Cited

U.S. PATENT DOCUMENTS

2007/0199610 A1 * 8/2007 Itagaki ..... E04G 21/123 140/93.6

FOREIGN PATENT DOCUMENTS

JP 2006-27685 A 2/2006
WO WO-2020050387 A1 * 3/2020 ..... B25B 25/00

* cited by examiner

*Primary Examiner* — Debra M Sullivan
(74) *Attorney, Agent, or Firm* — Oliff PLC

(57) ABSTRACT

A rebar tying machine may be configured to perform: a winding process in which a wire is fed around rebars, a vicinity of a distal end of the wire is grasped, the wire is pulled back, and the wire is cut; and a twisting process in which the wire is twisted. When instructed to tie the rebars by a user, the rebar tying machine may be configured capable of performing a multiple-winding tying operation in which the twisting process is performed after the winding process has been performed multiple times.

8 Claims, 32 Drawing Sheets

REBAR TYING MACHINE

CROSS-REFERENCE TO RELATED APPLICATION

This application claims priority to Japanese Patent Application No. 2020-112802, filed on Jun. 30, 2020, the entire contents of which are incorporated herein by reference.

TECHNICAL FIELD

The disclosure herein relates to a rebar tying machine.

BACKGROUND

Japanese Patent Application Publication No. 2006-27685 describes a rebar tying machine. The rebar tying machine is configured to perform a winding process in which a wire is fed around rebars and the wire is cut with multiple windings of the wire around the rebars, and a twisting process in which the wire is twisted.

SUMMARY

The rebar tying machine of Japanese Patent Application Publication No. 2006-27685 cuts the wire without pulling it back after feeding the wire around the rebars in the winding process, and thus the wire around the rebars has an increased winding diameter. When this wire with the increased winding diameter is twisted in the twisting process, a twisted portion of the wire is likely to be non-uniform and a tying force of the wire at the end of the twisting process tends to be varied. Further, an amount of the wire consumed in one tying operation is increased. The technique disclosed herein is provided to reduce the winding diameter of a wire wound around rebars in a rebar tying machine configured to twist the wire wound multiple times around the rebars.

A rebar tying machine is disclosed herein. The rebar tying machine may be configured to perform: a winding process in which a wire is fed around rebars, a vicinity of a distal end of the wire is grasped, the wire is pulled back, and the wire is cut; and a twisting process in which the wire is twisted. When instructed to tie the rebars by a user, the rebar tying machine may be configured capable of performing a multiple-winding tying operation in which the twisting process is performed after the winding process has been performed multiple times.

With the above configuration, the wire is fed out around the rebars and then the wire is pulled back and cut in the winding process, and thus the wire wound around the rebars has a reduced winding diameter. When this wound wire with the reduced winding diameter is twisted in the twisting process, a twisted portion of the wire is less likely to be non-uniform and variations in a tying force of the wire at the end of the twisting process can be reduced. Further, an amount of the wire consumed in one tying operation can be reduced.

DETAILED DESCRIPTION

Figure 1:
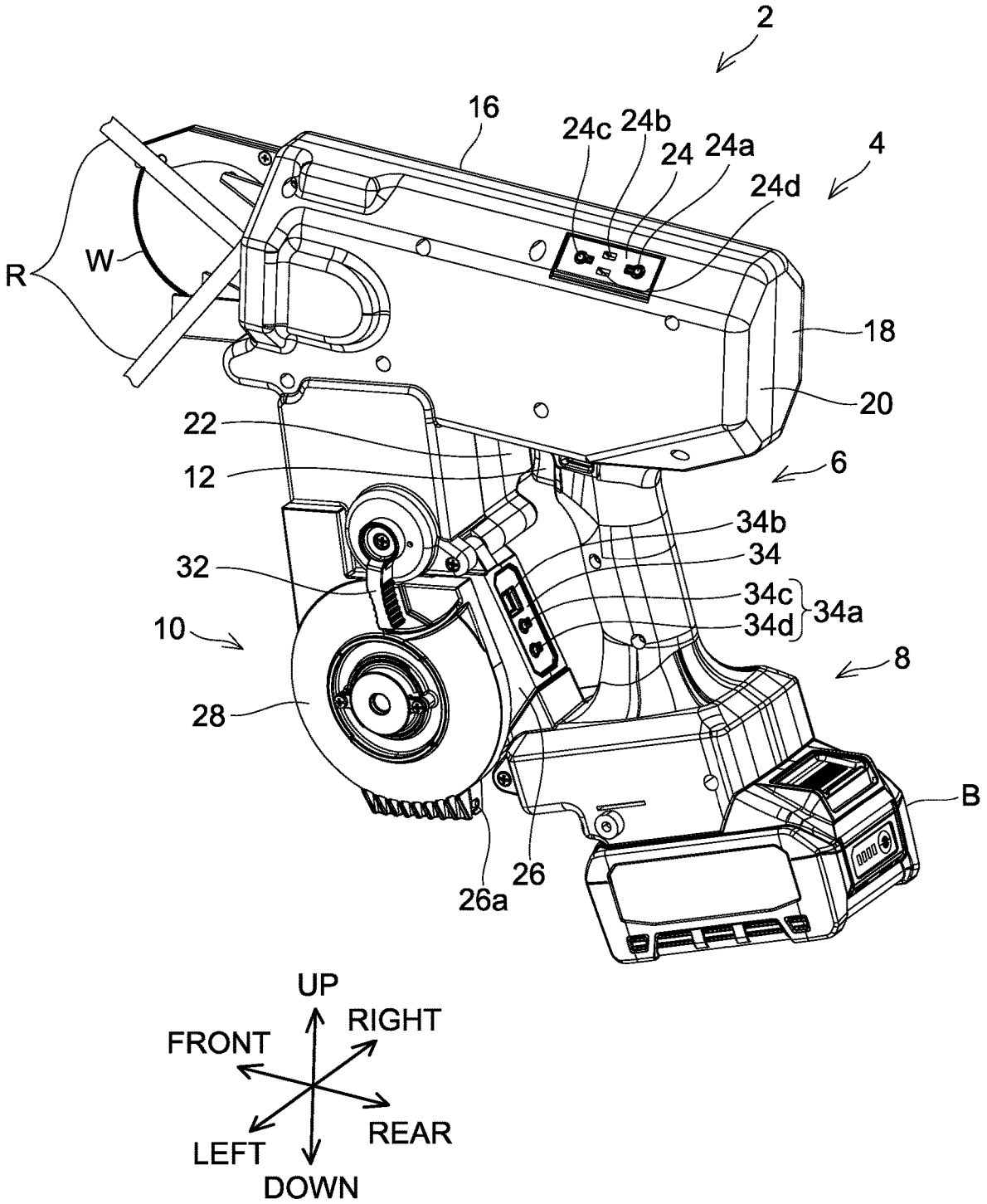
FIG. 1 is a perspective view showing a rebar tying machine 2 according to an embodiment from upper-left-rear side.

Representative, non-limiting examples of the present disclosure will now be described in further detail with reference to the attached drawings. This detailed description is merely intended to teach a person of skill in the art further details for practicing aspects of the present teachings and is not intended to limit the scope of the present disclosure. Furthermore, each of the additional features and teachings disclosed below may be utilized separately or in conjunction with other features and teachings to provide improved rebar tying machines, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, a rebar tying machine may be configured to perform: a winding process in which a wire is fed around rebars, a vicinity of a distal end of the wire is grasped, the wire is pulled back, and the wire is cut; and a twisting process in which the wire is twisted. When instructed to tie the rebars by a user, the rebar tying machine may be configured capable of performing a multiple-winding tying operation in which the twisting process is performed after the winding process has been performed multiple times.

With the above configuration, the wire is fed out around the rebars and then the wire is pulled back and cut in the winding process, and thus the wire wound around the rebars has a reduced winding diameter. When this wound wire with the reduced winding diameter is twisted in the twisting process, a twisted portion of the wire is less likely to be non-uniform and variations in a tying force of the wire at the end of the twisting process can be reduced. Further, an amount of the wire consumed in one tying operation can be reduced.

In one or more embodiments, when instructed to tie the rebars by the user, the rebar tying machine may be configured capable of performing a single-winding tying operation in which the twisting process is performed after the winding process has been performed once.

With the above configuration, the wire can be twisted after wound around the rebars once or the wire can be twisted after wound around the rebars multiple times depending on the situation.

In one or more embodiments, in the rebar tying machine, the wire may be wound around the rebars once when the winding process is performed once.

With a configuration in which the wire is fed and wound around the rebars multiple times and then it is pulled back and cut, the winding diameter of the wire might become non-uniform. However, in the configuration described above, the wire is pulled back and cut each time the wire is fed and wound around the rebars, and thus the winding diameter of the wire can be uniformized.

In one or more embodiments, in the rebar tying machine, a tying force of the wire in the twisting process may be settable by the user. A number of times the winding process is performed may be determined in accordance with the set tying force.

The larger a required tying force of the wire is, the more times the wire needs to be wound. With the configuration described above, how many times the wire should be wound can be automatically determined according to the tying force set by the user.

In one or more embodiments, in the rebar tying machine, a number of windings of the wire in the winding process may be settable by the user. A number of times the winding process is performed may be determined in accordance with the set number of windings.

With the configuration described above, the wire can be wound according to the number of windings the user desires.

In one or more embodiments, the rebar tying machine may comprise a cutting mechanism configured to cut the wire; and a motor configured to drive the cutting mechanism. The rebar tying machine may be configured to determine whether the wire has been cut based on a load of the motor in the winding process.

In the configuration described above, the load of the motor increases when the cutting mechanism cuts the wire, while the load of the motor decreases after the cutting mechanism has cut the wire. Whether the wire has been cut or not can be detected based on such a change in the load of the motor, and thus there is no need to use a special sensor to detect that.

In one or more embodiments, the rebar tying machine may be configured to determine that the wire has been cut when a rotational speed of the motor or a current flowing through the motor satisfies a predetermined condition in the winding process.

As the load of the motor increases, the rotational speed of the motor decreases and the current flowing through the motor increases. With the configuration described above, whether the wire has been cut or not can be determined using a Hall sensor configured to detect the rotational speed of the motor or a current detection circuit configured to detect the current flowing through the motor.

In one or more embodiments, a rebar tying machine may comprise a feeding mechanism configured to feed a wire around rebars, a twisting mechanism configured to twist the wire, a controller configured to control the feeding mechanism and the twisting mechanism, and a setting member with which a user sets a tying force of the wire. The controller may be configured to determine a number of windings of the wire in accordance with the set tying force.

The larger a required tying force of the wire is, the more times the wire needs to be wound. With the configuration described above, how many times the wire should be wound can be automatically determined according to the tying force set by the user.

(Embodiments)

As shown in FIG. 1, a rebar tying machine 2 is configured to fie a plurality of rebars R with a wire W. For example, the rebar tying machine 2 ties, with the wire W, rebars R having a small diameter of 16 mm or less or rebars R having a large diameter of greater than 16 mm (e.g., 25 mm or 32 mm). The diameter of the wire W is within a range from 0.5 mm to 2.0 mm, for example.

The rebar tying machine 2 comprises a main body 4, a grip 6, a battery interface 8, a battery pack B, and a reel holder 10. The grip 6 is a member configured to be gripped by an operator. The grip 6 is disposed at a lower rear portion of the main body 4. The grip 6 is integral with the main body 4. A trigger 12 is attached to an upper front portion of the grip 6. A trigger switch 14 (see FIG. 3) configured to detect whether the trigger 12 has been pressed or not is housed in the grip 6. The battery interface 8 is disposed at a lower portion of the grip 6. The battery interface 8 is integral with the grip 6. The battery pack B can be attached to and detached from the battery interface 8 by being slid relative to the battery interface 8. The battery pack B comprises secondary batteries such as lithium-ion batteries. The reel holder 10 is disposed at a lower front portion of the main body 4. The reel holder 10 is disposed forward of the grip 6. In the present embodiment, a longitudinal direction of a wire twisting mechanism 46 (which will be described) is termed a front-rear direction, a direction perpendicular to the front-rear direction is termed an up-down direction, and a direction perpendicular to the front-rear direction and the up-down direction is to a right-left direction.

Figure 2:
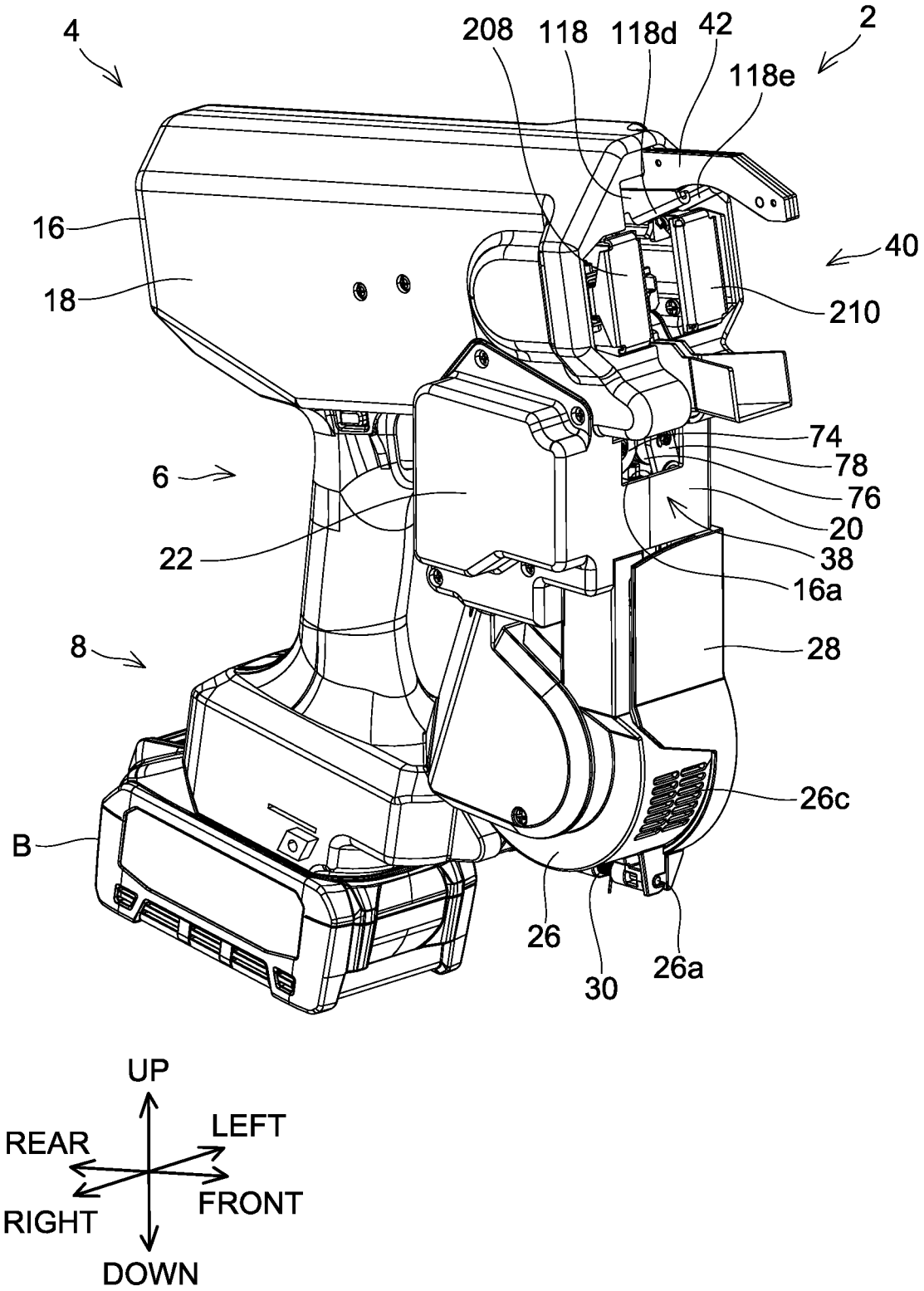
FIG. 2 is a perspective view showing the rebar tying machine 2 according to the embodiment from upper-right-front side.

The rebar tying machine 2 comprises a housing 16. As shown in FIG. 2, the housing 16 comprises a right housing 18, a left housing 20, and a motor cover 22. The right housing 18 defines shapes of right halves of the main body 4, the grip 6, and the battery interface 8. The left housing 20 defines shapes of left halves of the main body 4, the grip 6, and the battery interface 8. The motor cover 22 is attached to an outer side of the right housing 18. As shown in FIG. 1, a first operation display 24 is disposed at an upper rear portion of the left housing 20. The first operation display 24 comprises a main power switch 24*a*, a main power LED 24*b*, a mode selection switch 24*c*, and a mode display LED 24*d*. The main power switch 24*a* is configured to receive an operation to turn on/turn off the rebar tying machine 2 from the user. The main power LED 24*b* is configured to display whether the rebar tying machine 2 is ON or OFF. The mode selection switch 24*c* is configured to receive an operation to switch operation modes of the rebar tying machine 2 from the user. The mode display LED 24*d* is configured to display an operation mode of the rebar tying machine 2. In the rebar tying machine 2 according to the present embodiment, either a single mode or a multiple mode is selectable as the operation mode.

The reel holder 10 comprises a holder housing 26 and a cover 28. The holder housing 26 is coupled to the lower front portion of the main body 4 and a front portion of the battery interface 8. The cover 28 is attached to the holder housing 26 such that it is rotatable about a rotation shaft 26*a* disposed at a lower portion of the holder housing 26. The cover 28 is biased in an open direction by a torsion spring 30 (see FIG. 2). A lock lever 32 configured to keep the cover 28 closed is disposed at a lower front portion of the left housing 20. When the lock lever 32 is rotated, the cover 28 is opened with respect to the holder housing 26 by the biasing force of the torsion spring 30. While the cover 28 is closed, a housing space 26*b* (see FIG. 3) is defined by the holder housing 26 and the cover 28. A reel 33 around which the wire W is wound is housed in the housing space 26*b*. The reel 33 is rotatably supported by the holder housing 26 and the cover 28. As shown in FIG. 2, a hole 26*c* is formed in a front surface of the holder housing 26. The user can check an amount of the wire W remaining on the reel 33 by seeing the reel 33 through the hole 26*c*.

As shown in FIG. 1, a second operation display 34 is disposed on a rear surface of the holder housing 26. The second operation display 34 comprises a setting selection switch 34*a* and a setting display LED 34*b*. The setting selection switch 34*a* comprises a tying force increasing switch 34*c* and a tying force reducing switch 34*d*. In the rebar tying machine 2 according to the present embodiment, a tying force of the wire W is settable from among six levels, namely levels 1, 2, 3, 4, 5, and 6. The tying force increasing switch 34*c* is configured to receive an operation to increase the tying force of the wire W from the user. The tying force reducing switch 34*d* is configured to receive an operation to reduce the tying force of the wire W from the user. The setting display LED 34*b* is configured to display a current setting for the tying force of the wire W. For example, the setting display LED 34*b* is normally off, however, when the tying force increasing switch 34*c* or the tying force reducing switch 34*d* is manipulated, the setting display LED 34*b* is turned on and displays a current setting value for the tying force of the wire W. When the tying force increasing switch 34*c* is manipulated in that state, the setting value for the tying force of the wire W is increased by one level, whereas when the tying force reducing switch 34*d* is manipulated in that state, the setting value for the tying force of the wire W is reduced by one level. When a predetermined period of time elapses without any manipulation performed on the tying force increasing switch 34*c* nor the tying force reducing switch 34*d* in a state where the setting display LED 34*b* is displaying the current setting for the tying force of the wire W, the setting display LED 34*b* is turned off.

Figure 3:
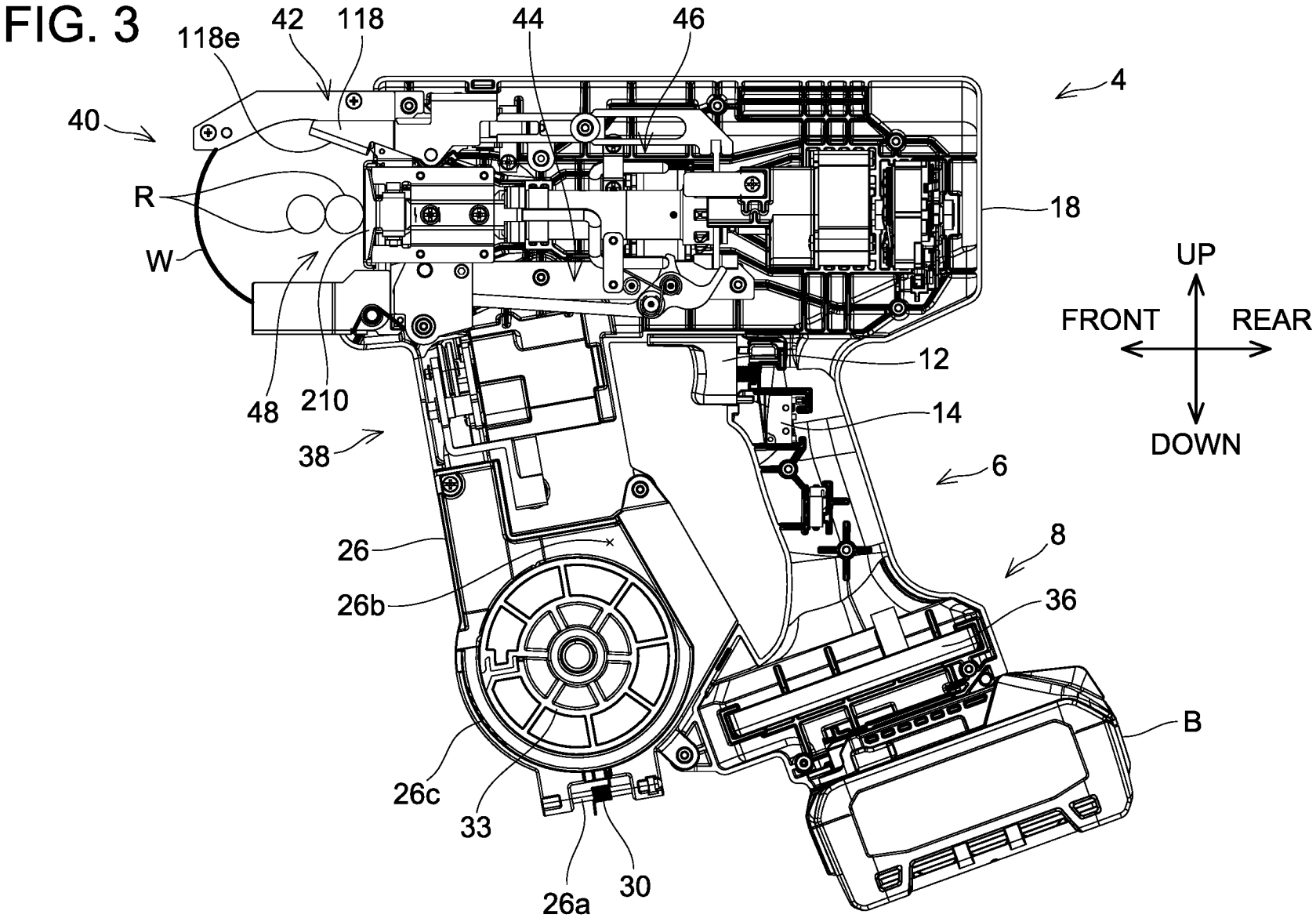
FIG. 3 is a side view showing an internal structure of the rebar tying machine 2 according to the embodiment.

As shown in FIG. 3, the rebar tying machine 2 comprises a control circuit board 36. The control circuit board 36 is housed in the battery interface 8. The battery pack B, the trigger switch 14, the first operation display 24, and the second operation display 34 are connected to the control circuit board 36 via respective wiring (not shown).

The rebar tying machine 2 comprises a wire feeding mechanism 38, a wire guiding mechanism 40, a rebar contacting mechanism 42, a wire cutting mechanism 44, a wire twisting mechanism 46, and a rebar pressing mechanism 48. The wire feeding mechanism 38 is disposed at the lower front portion of the main body 4. The wire guiding mechanism 40 is disposed at a front portion of the main body 4. The rebar contacting mechanism 42 is disposed at the front portion of the main body 4. The wire cutting mechanism 44 is housed in a lower portion of the main body 4. The wire twisting mechanism 46 is housed in the main body 4. The rebar pressing mechanism 48 is disposed at the front portion of the main body 4.

(Configuration of Wire Feeding Mechanism 38)

Figure 4:
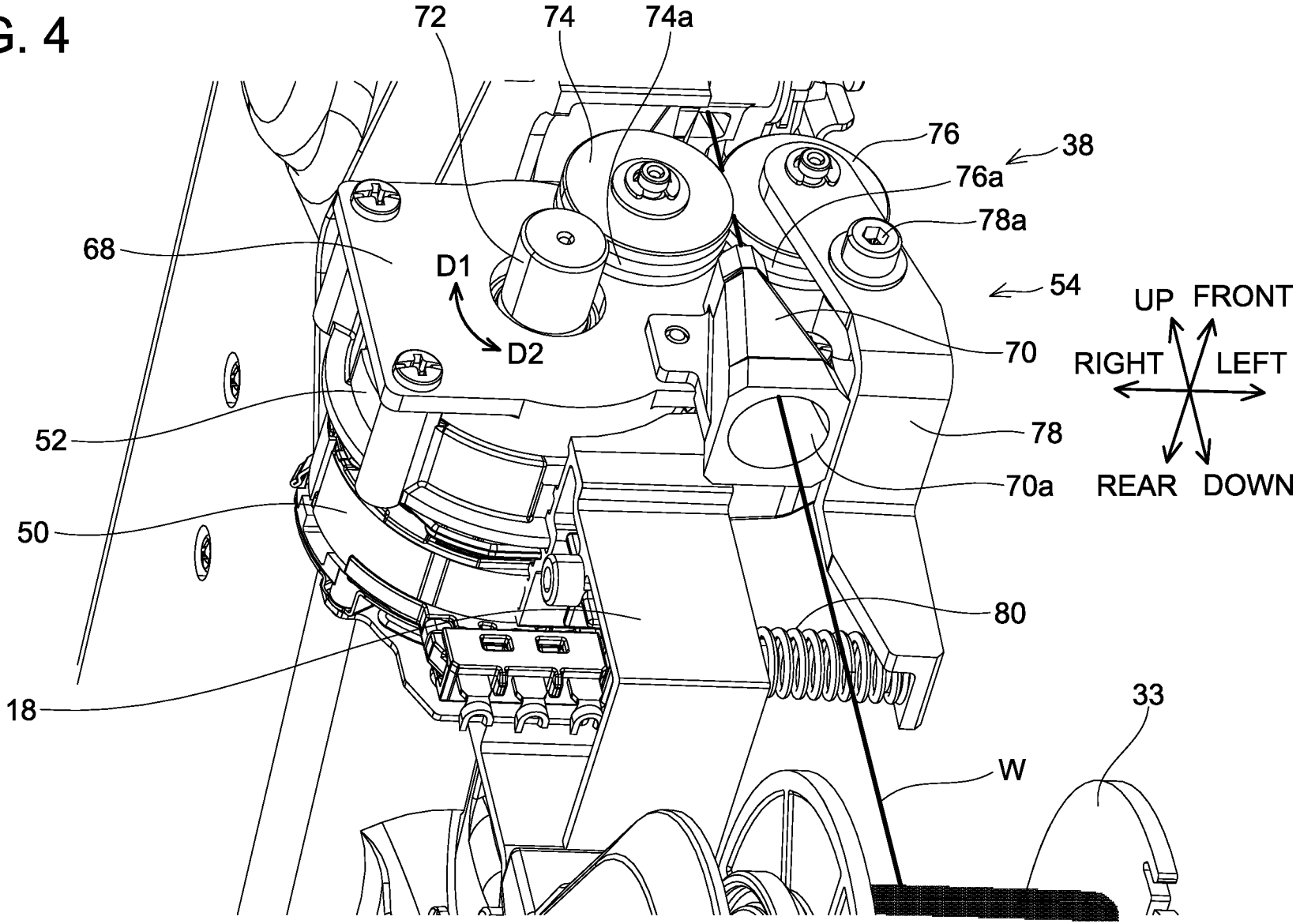
FIG. 4 is a perspective view showing a wire feeding mechanism 38 of the rebar tying machine 2 according to the embodiment.

As shown in FIG. 4, the wire feeding mechanism 38 comprises a feeding motor 50, a speed reducer 52, and a feeder 54. The feeding motor 50 is connected to the control circuit board 36 via wiring (not shown). The feeding motor 50 is driven by electric power supplied from the battery pack B. The feeding motor 50 is controlled by the control circuit board 36. The speed reducer 52 comprises, for example, a planetary gear mechanism and is configured to reduce the rotational speed of the feeding motor 50 and transmit it to the feeder 54.

Figure 5:
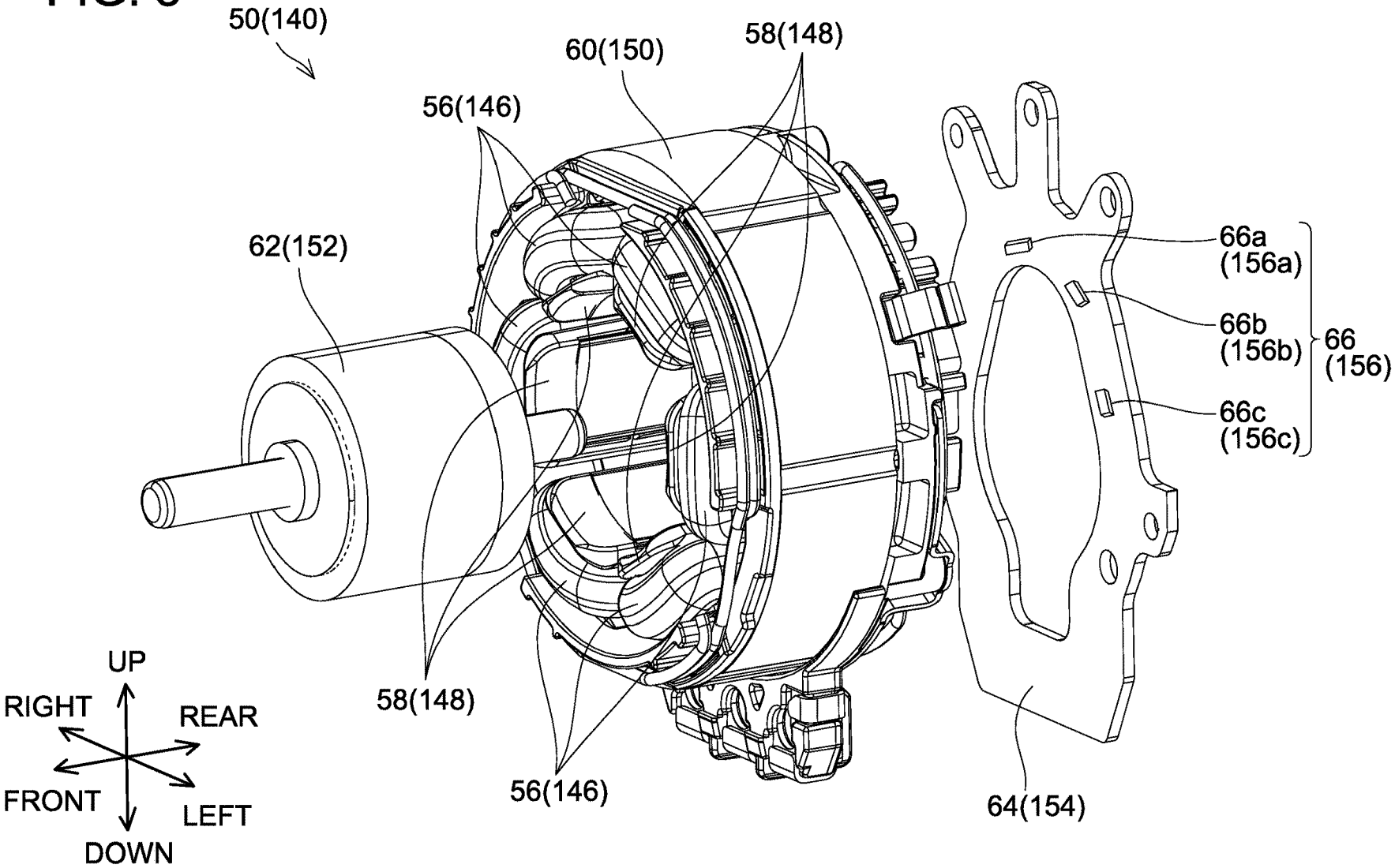
FIG. 5 is an exploded perspective view showing a feeding motor 50 and a twisting motor 140 of the rebar tying machine 2 according to the embodiment.

The feeding motor 50 is a brushless motor, for example. The feeding motor 50 is disposed rightward of the right housing 18 and is covered by the motor cover 22 (see FIG. 2). As shown in FIG. 5, the feeding motor 50 comprises a stator 60 that includes teeth 58 on which coils 56 are wound, a rotor 62 disposed inside the stator 60, and a sensor board 64 fixed to the stator 60. The stator 60 is constituted of a magnetic body. The rotor 62 comprises a permanent magnet in which magnetic poles are circumferentially arranged. The sensor board 64 comprises a Hall sensor 66. The Hall sensor 66 comprises a first Hall element 66*a*, a second Hall element 66*b*, and a third Hall element 66*c*. The first Hall element 66*a*, the second Hall element 66*b*, and the third Hall element 66*c* are configured to sense a magnetic force from the rotor 62.

As shown in FIG. 4, the feeder 54 comprises a base 68, a guide 70, a drive gear 72, a first feed gear 74, a second feed gear 76, a release lever 78, and a compression spring 80. The guide 70 is fixed to the base 68. The guide 70 has a guide hole 70*a*. The guide hole 70*a* has a tapered shape with a broad lower end and a narrower upper end. The wire W is inserted through the guide hole 70*a*.

Rotation is transmitted to the drive gear 72 from the speed reducer 52. The first feed gear 74 is rotatably supported by the base 68. The first feed gear 74 is meshed with the drive gear 72. The first feed gear 74 is rotated by the rotation of the drive gear 72. The first feed gear 74 has a groove 74*a*. The groove 74*a* is formed in an outer circumferential surface of the first feed gear 74 and extends in a direction along a rotation direction of the first feed gear 74. The second feed gear 76 is configured to mesh with the first feed gear 74. The second feed gear 76 is rotatably supported by the release lever 78. The second feed gear 76 has a groove 76*a*. The groove 76*a* is formed in an outer circumferential surface of the second feed gear 76 and extends in a direction along a rotation direction of the second feed gear 76. The release lever 78 is swingably supported by the base 68 via a swing shaft 78*a*. The compression spring 80 biases the release lever 78 with respect to the right housing 18 in a direction that brings the second feed gear 76 closer to the first feed gear 74. Thus, the second feed gear 76 is pressed against the first feed gear 74. Thereby, the wire W is held between the groove 74*a* of the first feed gear 74 and the groove 76*a* of the second feed gear 76. When the lock lever 32 (see FIG. 1) is rotated in a direction that releases the cover 28 (see FIG. 1) from the closed state, a lower end of the release lever 78 is pushed by the lock lever 32 and is moved toward the right housing 18. Thus, the second feed gear 76 separates away from the first feed gear 74. In this state, the user can place the wire W, which extends from the reel 33, between the groove 74*a* of the first feed gear 74 and the groove 76*a* of the second feed gear 76. As shown in FIG. 2, a window 16*a* is formed in front surfaces of the left housing 20 and the motor cover 22, and the user can see a site where the first feed gear 74 meshes with the second feed gear 76 through the window 16*a*.

The wire W is moved when the feeding motor 50 rotates with the wire W held between the groove 74*a* of the first feed gear 74 and the groove 76*a* of the second feed gear 76 as shown in FIG. 4. In the present embodiment, when the feeding motor 50 rotates forward, the drive gear 72 is rotated in a direction D1 shown in FIG. 4, and thereby the wire W is fed out from the reel 33 toward the wire guiding mechanism 40. When the feeding motor 50 rotates in reverse, the drive gear 72 is rotated in a direction D2 shown in FIG. 4, and thereby the wire W is pulled back toward the reel 33 from the wire guiding mechanism 40.

(Configuration of Wire Guiding Mechanism 40)

Figure 6:
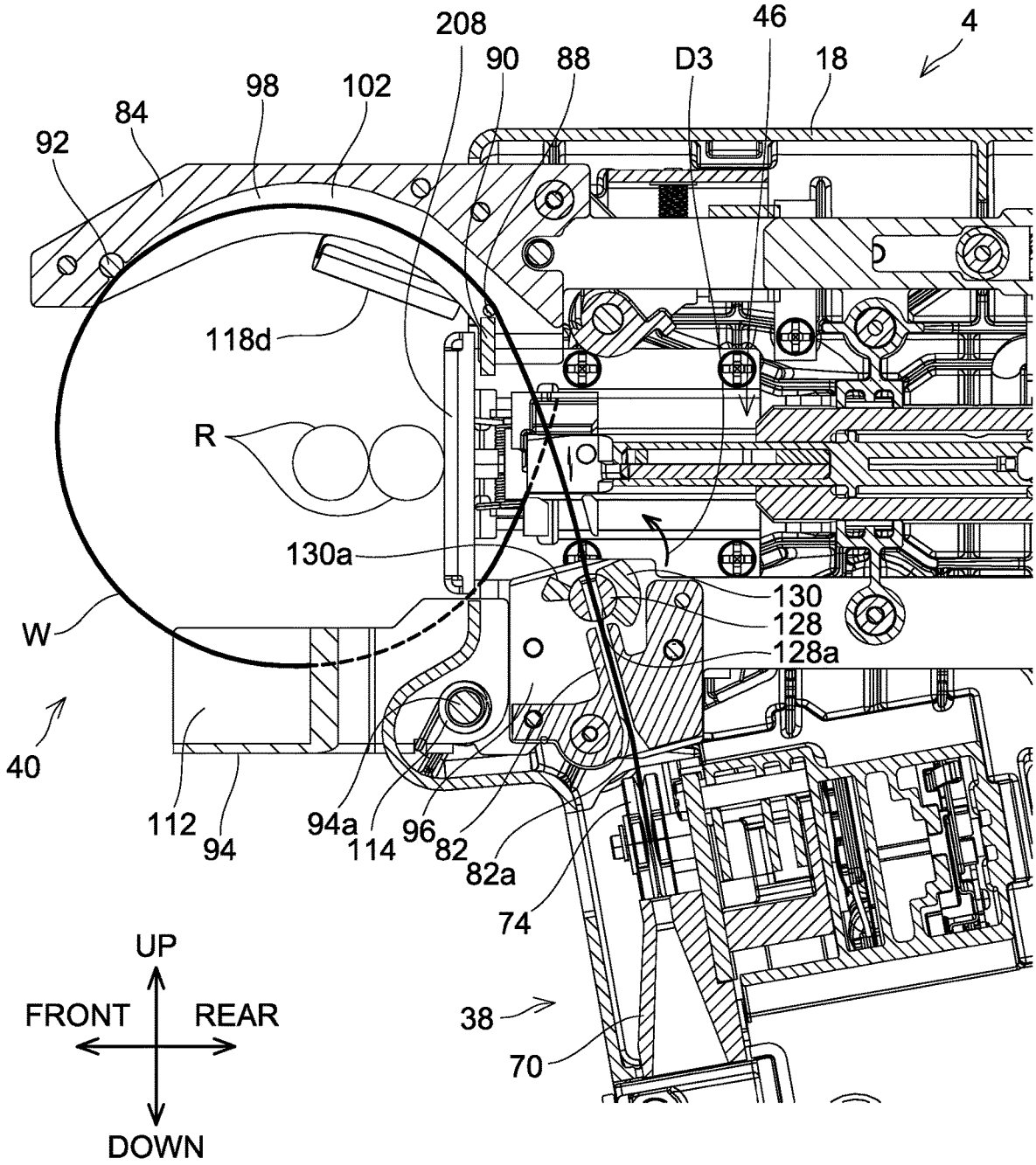
FIG. 6 is a cross sectional view showing an area around a wire guiding mechanism 40 of the rebar tying machine 2 according to the embodiment.

As shown in FIG. 6, the wire guiding mechanism 40 comprises a guide 82, an upper curl guide 84, a movable guide pin 88, a movable guide plate 90, a fixed guide pin 92, and a lower curl guide 94.

The guide 82 is fixed to the vicinity of a front end of a lower base 96 that extends in the front-rear direction within the lower portion of the main body 4. The lower base 96 is fixed to the right housing 18. The guide 82 has a hole 82*a* through which the wire W fed out from the wire feeding mechanism 38 passes.

The upper curl guide 84 is disposed at an upper front portion of the main body 4. The upper curl guide 84 is interposed between an upper base 98 and an upper guide cover 100 (see FIG. 7). The upper base 98 extends in the front-rear direction within an upper portion of the main body 4 and is fixed to the right housing 18. The upper curl guide 84 and the upper guide cover 100 are fixed to the vicinity of a front end of the upper base 98. The upper curl guide 84, the upper base 98, and the upper guide cover 100 protrude forward beyond front ends of the right housing 18 and the left housing 20. A lower surface of the upper curl guide 84 has an upwardly curved surface shape with respect to the front-rear direction and is positioned above lower surfaces of the upper base 98 and the upper guide cover 100. An upper wire passage 102 is defined by the lower surface of the upper curl guide 84, a left surface of the upper base 98, and a right surface of the upper guide cover 100.

Figure 7:
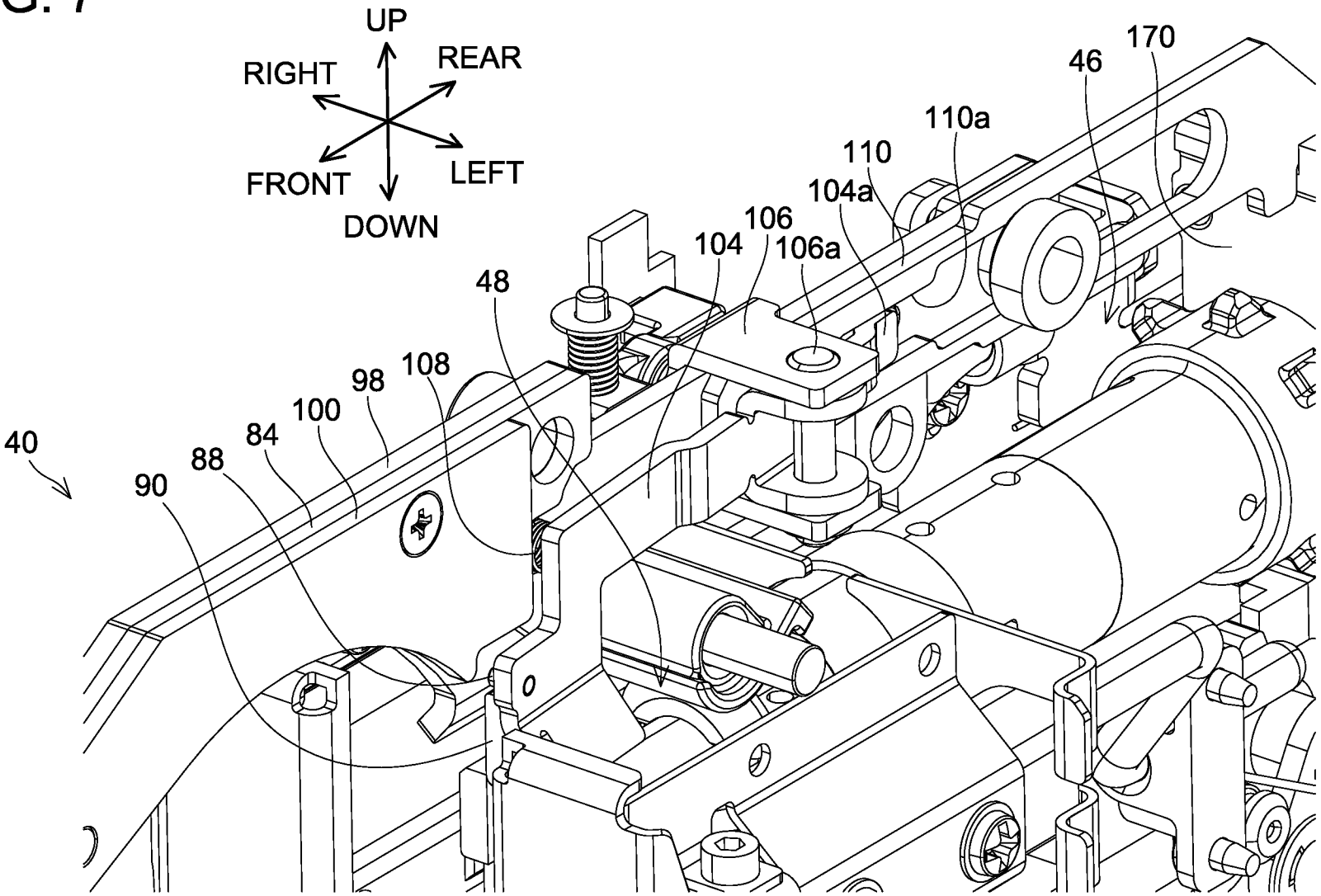
FIG. 7 is a perspective view showing that a movable guide pin 88 and a movable guide plate 90 are separated from an upper base 98 in the wire guiding mechanism 40 of the rebar tying machine 2 according to the embodiment.
Figure 8:
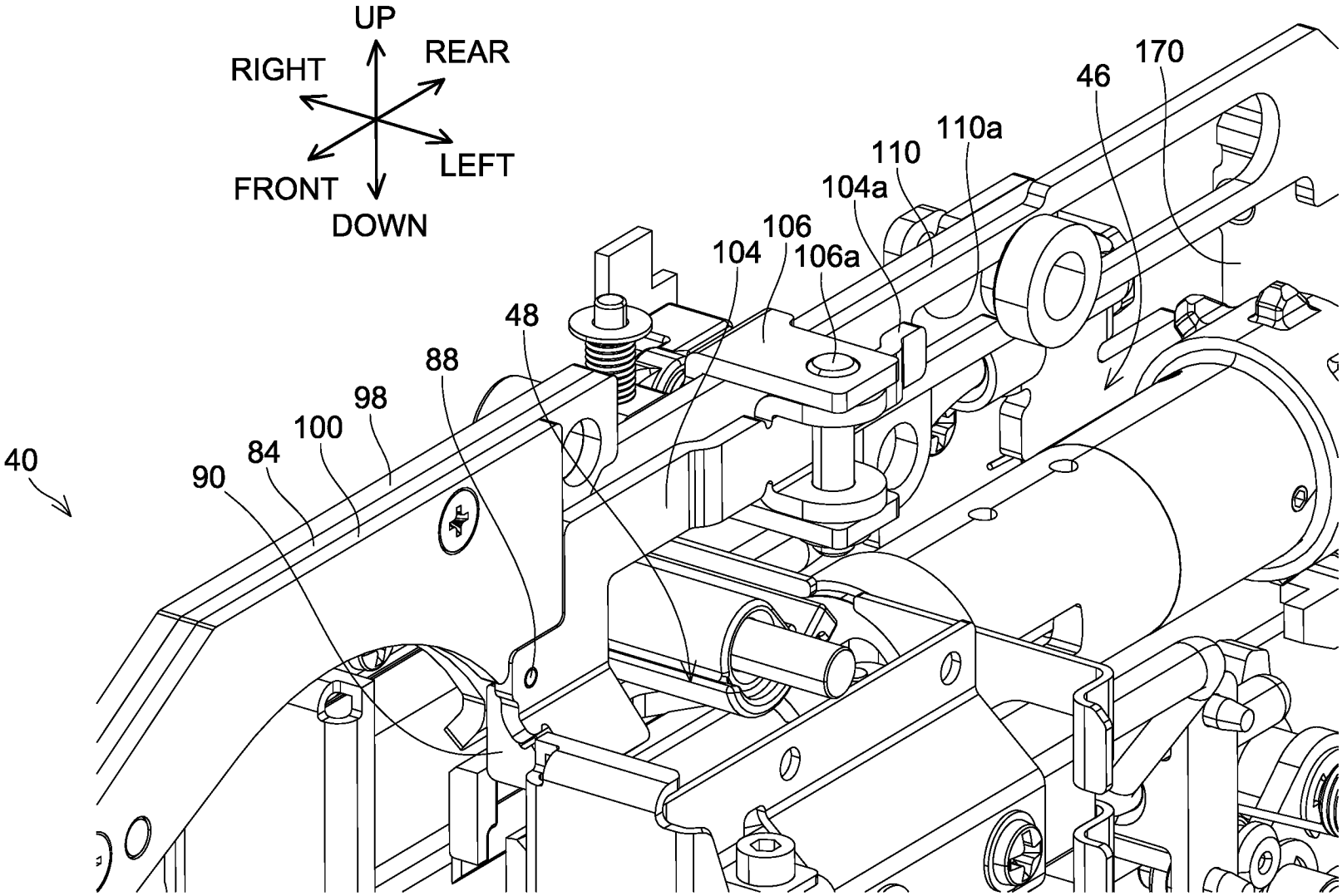
FIG. 8 is a perspective view showing that the movable guide pin 88 and the movable guide plate 90 are in contact with the upper base 98 in the wire guiding mechanism 40 of the rebar tying machine 2 according to the embodiment.

The fixed guide pin 92 is disposed near a front end of the upper wire passage 102. The fixed guide pin 92 is fixed to the upper base 98 and the upper guide cover 100. The movable guide pin 88 and the movable guide plate 90 are disposed near a rear end of the upper wire passage 102. As shown in FIG. 7, the movable guide pin 88 and the movable guide plate 90 are fixed to the vicinity of a front end of a swing plate 104. The swing plate 104 is swingably supported, via a swing shaft 106*a*, by an auxiliary base 106 fixed to the upper base 98. The swing plate 104 is biased at the vicinity of its front end by a compression spring 108 in a direction that brings the swing plate 104 separated away from the upper base 98. A slide plate 110 is interposed between the upper base 98 and the swing plate 104. The slide plate 110 extends in the front-rear direction within the upper portion of the main body 4. The slide plate 110 is supported by the upper base 98 such that it is slidable in the front-rear direction. The slide plate 110 has an elongated hole 110*a* extending in the front-rear direction. When the slide plate 110 is slid forward as shown in FIG. 7, a rear end 104*a* of the swing plate 104 enters the elongated hole 110*a* of the slide plate 110. Also, the front end of the swing plate 104 moves leftward such that the movable guide pin 88 and the movable guide plate 90 separate from the upper base 98. This prevents the wire W from being caught at the movable guide pin 88 and/or the movable guide plate 90 when the wire feeding mechanism 38 pulls back the wire W. When the slide plate 110 is slid rearward as shown in FIG. 8, the rear end 104*a* of the swing plate 104 comes out of the elongated hole 110*a* and climbs onto the slide plate 110. Also, the front end of the swing plate 104 moves rightward such that the movable guide pin 88 and the movable guide plate 90 contact the upper base 98. This enables the movable guide pin 88 and the movable guide plate 90 to guide the wire W when the wire feeding mechanism 38 feeds out the wire W.

Figure 9:
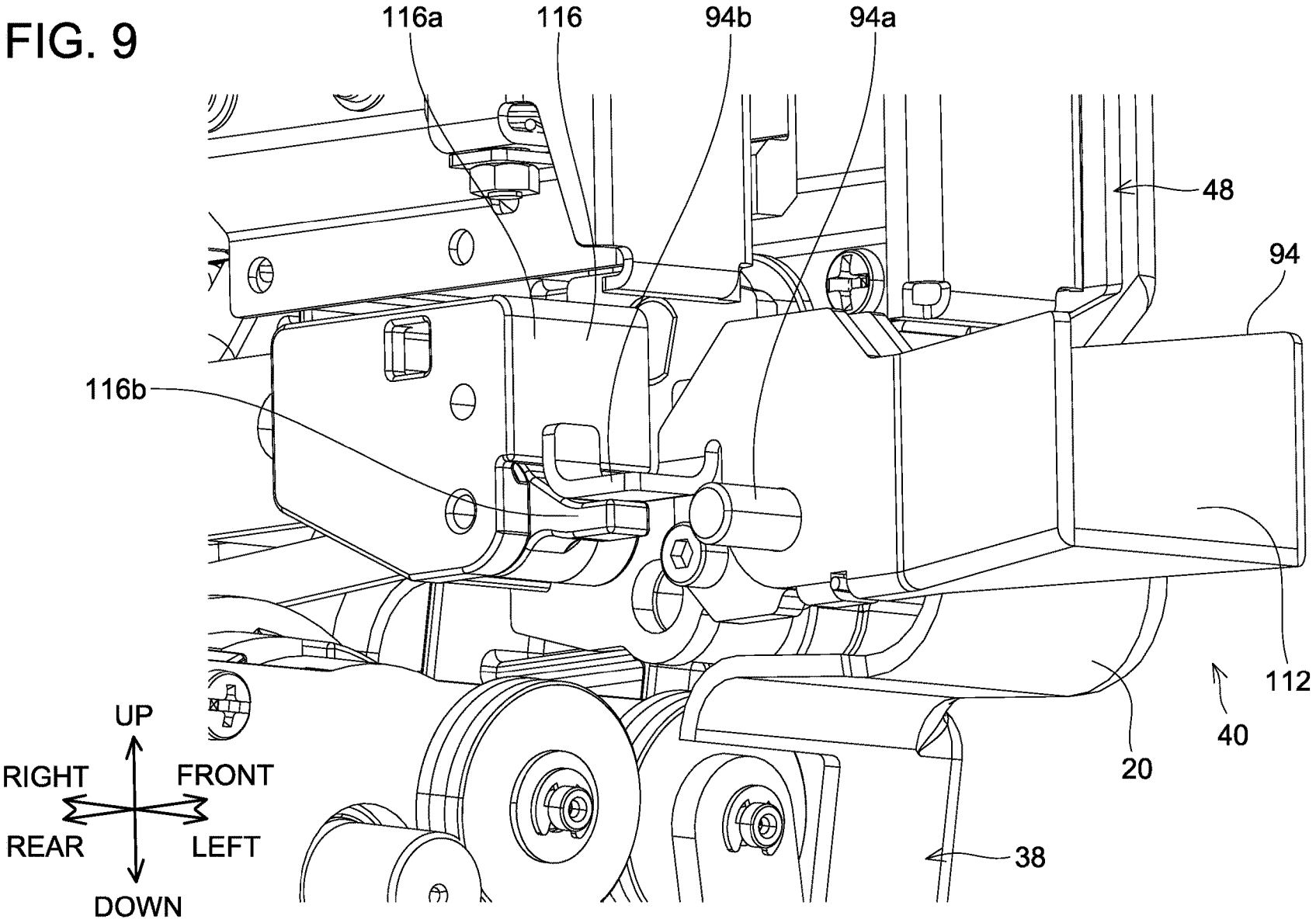
FIG. 9 is a perspective view showing a structure around a lower curl guide 94 of the wire guiding mechanism 40 of the rebar tying machine 2 according to the embodiment.

As shown in FIG. 6, the lower curl guide 94 is disposed at the lower front portion of the main body 4. As shown in FIG. 9, the lower curl guide 94 is open upward and has a substantially U-shaped cross section. The width of the lower curl guide 94 in the right-left direction is increased from its rear end toward its front end. The lower curl guide 94 defines a lower wire passage 112. The lower curl guide 94 is supported by the right housing 18 and the left housing 20 such that it is swingable about a swing shaft 94*a*. The lower curl guide 94 is biased by a torsion spring 114 (see FIG. 6) in a closing direction (in a direction that brings the front end of the lower curl guide 94 upward). The user can swing the lower curl guide 94 in an opening direction (in a direction that brings the front end of the lower curl guide 94 downward) by pushing down the end of the lower curl guide 94 against the biasing force of the torsion spring 114. A contact piece 94*b* protruding rightward is disposed near the rear end of the lower curl guide 94. An opening/closing detector 116 is disposed near the contact piece 94*b*. The opening/closing detector 116 comprises a casing 116*a* fixed to the right housing 18, a lever 116*b* swingable supported by the casing 116*a*, a compression spring (not shown) disposed inside the casing 116*a* and biasing the lever 116*b* toward the contact piece 94*b*, a permanent magnet (not shown) disposed inside the casing 116*a* and fixed to the lever 116*b*, and a magnetic sensor (not shown) disposed inside the casing 116*a* and configured to detect magnetism from the permanent magnet of the lever 116*b*. The magnetic sensor is connected to the control circuit board 36 via wiring (not shown). The permanent magnet and the magnetic sensor of the opening/closing detector 116 constitute an opening/closing detection sensor 117 (see FIG. 29). The opening/closing detection sensor 117 is configured to detect whether the lower curl guide 94 is open or closed. The opening/closing detection sensor 117 is OFF when the lower curl guide 94 is closed, while it is ON when the lower curl guide 94 is open.

As shown in FIG. 6, the wire W fed out from the wire feeding mechanism 38 passes through the guide 82 and then is directed into the upper wire passage 102. The lower surface of the upper curl guide 84, the movable guide pin 88, and the fixed guide pin 92 give a downward curl to the wire W directed into the upper wire passage 102 by contacting the wire W in a sliding manner while the wire W is passing through the upper wire passage 102 from the rear end to the front end. After passing through the upper wire passage 102, the wire W is directed into the lower wire passage 112. The wire W directed into the lower wire passage 112 passes through the lower wire passage 112 from the front end to the rear end, and then the wire W is directed in an upper rear direction. As above, the wire W is wound around the rebars R.

(Configuration of Rebar Contacting Mechanism 42)

Figure 10:
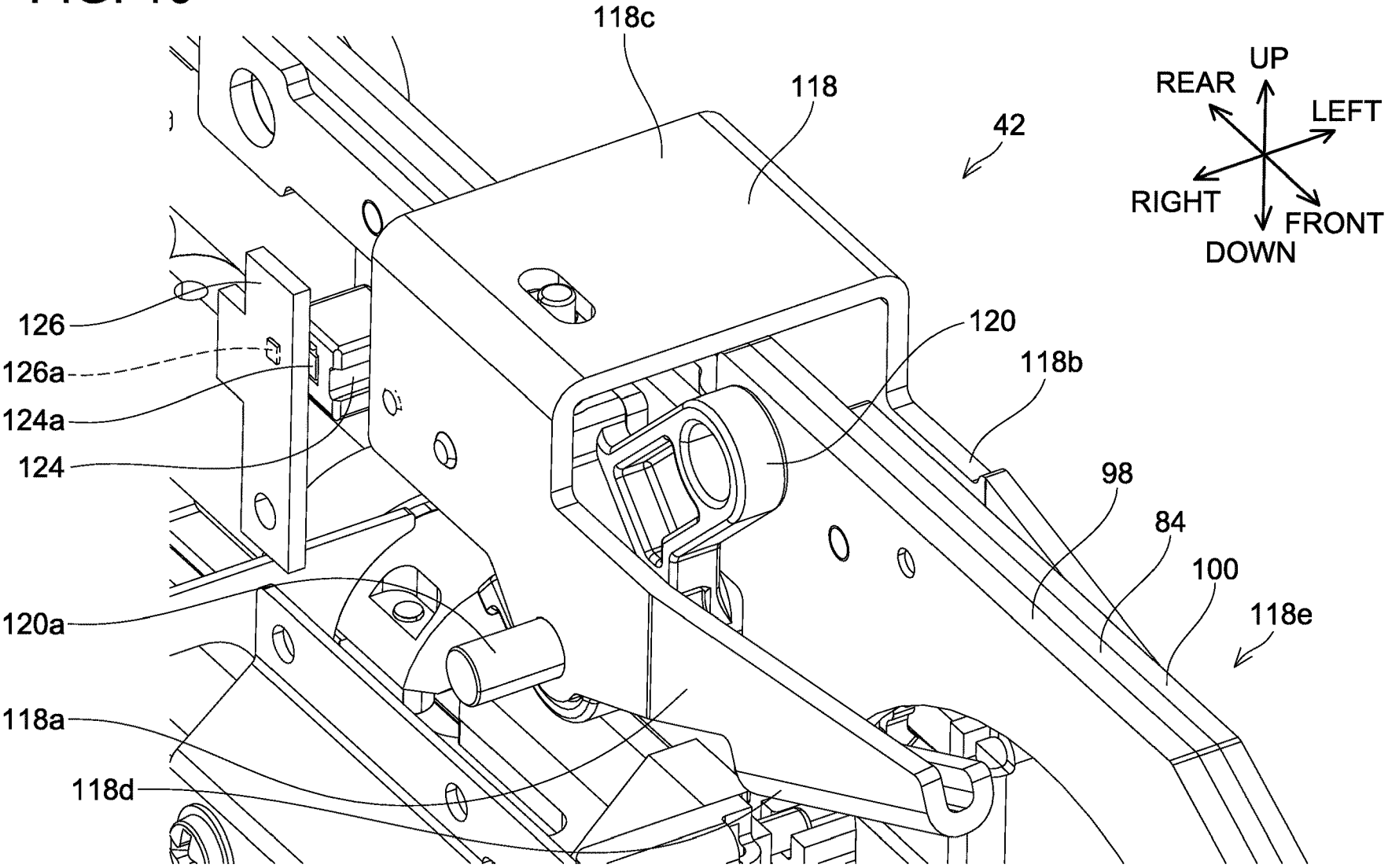
FIG. 10 is a perspective view showing a structure of a rebar contacting mechanism 42 of the rebar tying machine 2 according to the embodiment.
Figure 11:
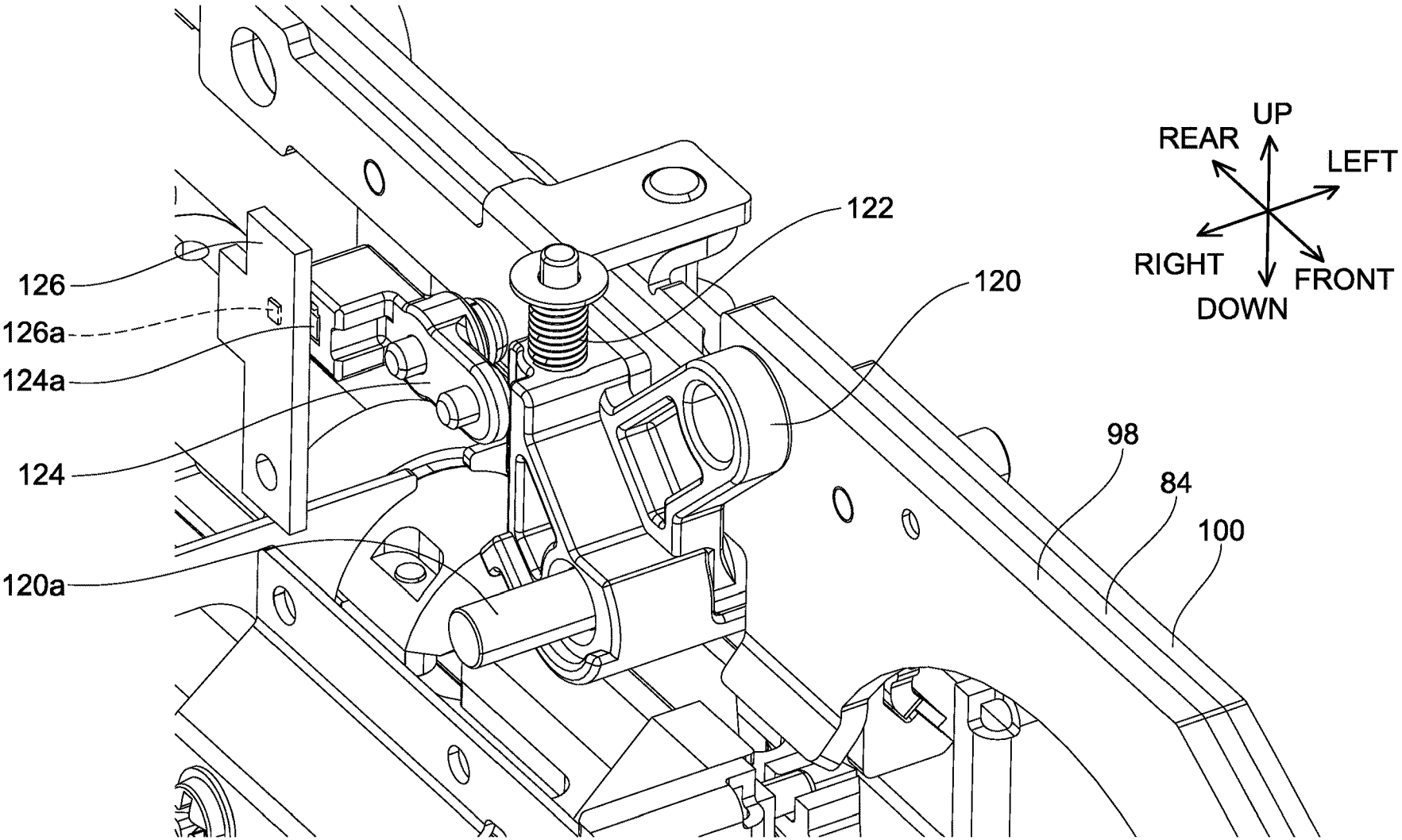
FIG. 11 is a perspective view showing the structure of the rebar contacting mechanism 42 of the rebar tying machine 2 according to the embodiment, except for a contact arm 118.

As shown in FIGS. 10 and 11, the rebar contacting mechanism 42 comprises a contact arm 118, an arm holder 120, a compression spring 122, a magnet holder 124, and a sensor board 126. The contact arm 118 comprises a right arm portion 118*a* disposed rightward of the upper base 98 and extending in the front-rear direction, a left arm portion 118*b* disposed leftward of the upper guide cover 100 and extending in the front-rear direction, and a connecting portion 118*c* extending in the right-left direction above the upper base 98, the upper curl guide 84, and the upper guide cover 100 and connecting a rear end of the right arm portion 118*a* with a rear end of the left arm portion 118*b*. The right arm portion 118*a* and the left arm portion 118*b* protrude forward beyond the front ends of the right housing 18 and the left housing 20. A lower front surface of the right arm portion 118*a* comprises a right contact portion 118*d* positioned below the lower surface of the upper base 98. A lower front surface of the left arm portion 118*b* includes a left contact portion 118*e* positioned below the lower surface of the upper guide cover 100. The contact arm 118 is swingable supported by the arm holder 120 via a swing shaft 120*a* extending in the right-left direction. The arm holder 120 is fixed to the right housing 18 and the left housing 20. The compression spring 122 is interposed between the connecting portion 118*c* of the contact arm 118 and the arm holder 120. The compression spring 122 biases the contact arm 118 with respect to the arm holder 120 in a direction that brings the right contact portion 118*d* and the left contact portion 118*e* downward. The magnet holder 124 is fixed at the vicinity of the rear end of the right arm portion 118*a* of the contact arm 118. The magnet holder 124 comprises a permanent magnet 124*a*. The sensor board 126 is fixed to the right housing 18. The sensor board 126 comprises a magnetic sensor 126*a* configured to detect magnetism from the permanent magnet 124*a*. The sensor board 126 is connected to the control circuit board 36 via wiring (not shown). The permanent magnet 124*a* and the magnetic sensor 126*a* constitute a contact detection sensor 125 (see FIG. 29).

The rebar contacting mechanism 42 is used when the operation mode of the rebar tying machine 2 is set in the multiple mode. When the contact arm 116 is not in contact with the rebars R, the right contact portion 118*d* and the left contact portion 118*e* are pressed downward by the biasing force of the compression spring 122. When the user makes the rebars R contact the right contact portion 118*d* and the left contact portion 118*e* of the contact arm 118, the contact arm 118 swings about the swing shaft 120*a* and the magnetism from the permanent magnet 124*a* detected by the magnetic sensor 126*a* changes. The contact detection sensor 125 can thereby detect that the rebars 1 are in contact with the contact arm 118. The contact detection sensor 125 is OFF when the rebars R are not in contact with the contact arm 118, while it is ON when the rebars R are in contact with the contact arm 118.

(Configuration of Wire Cutting Mechanism 44)

Figure 12:
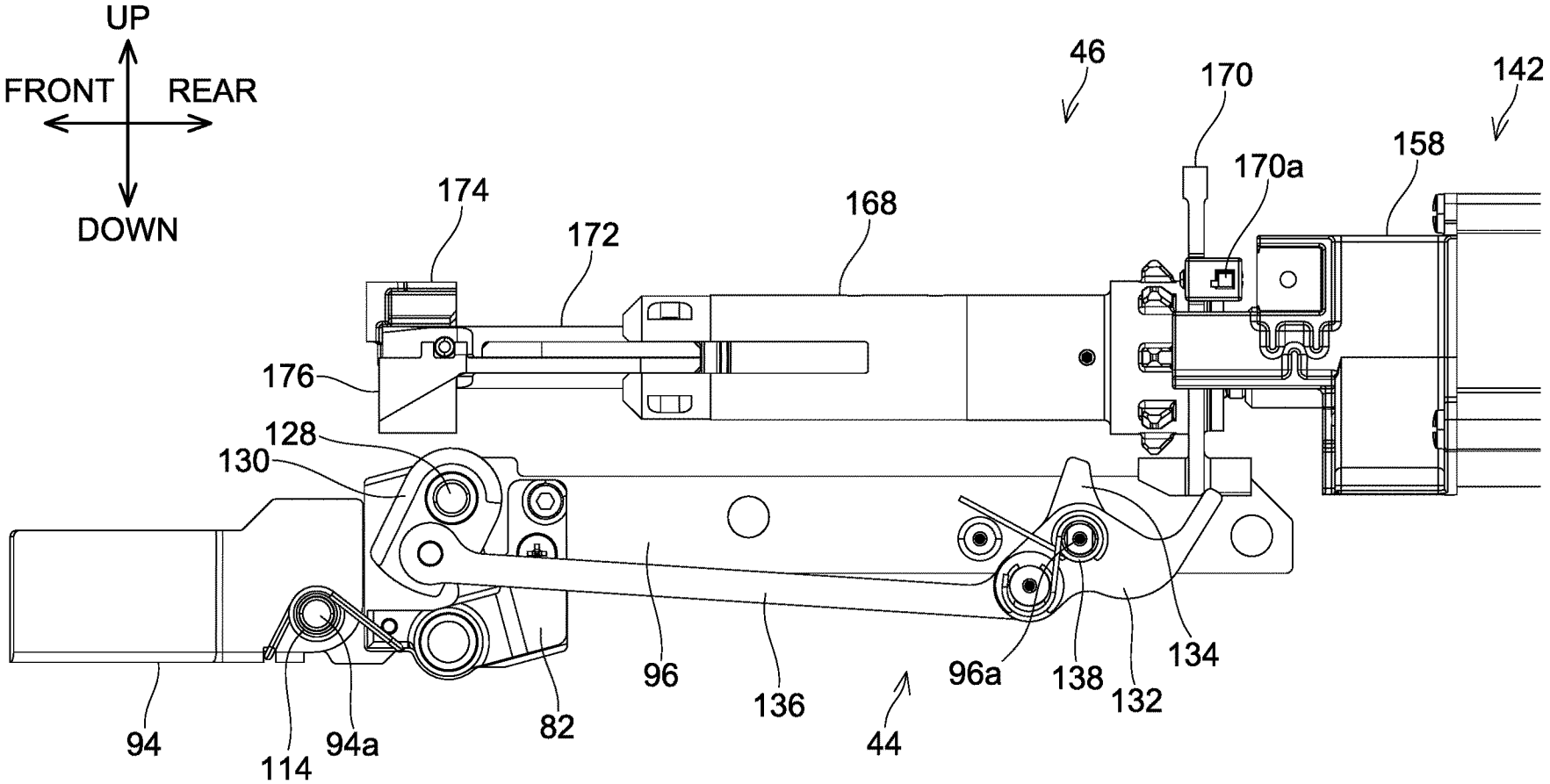
FIG. 12 is a side view showing that a fixed cutter 128 and a movable cutter 130 are in a communicated state in a wire cutting mechanism 44 of the rebar tying machine 2 according to the embodiment.

As shown in FIG. 12, the wire cutting mechanism 44 comprises a fixed cutter 128, a movable cutter 130, a first lever 132, a second lever 134, a link 136, and a torsion spring 138. As shown in FIG. 6, the fixed cutter 128 and the movable cutter 130 are on the path along which the wire W is directed from the guide 82 to the upper curl guide 84 in the wire guiding mechanism 40. The fixed cutter 128 is fixed to the lower base 96. The fixed cutter 128 has a hole 128*a* through which the wire W passes. The movable cutter 130 is supported by the fixed cutter 128 such that it can slide along and rotate about the fixed cutter 128. The movable cutter 130 has an opening 130*a* through which the wire W can pass. When the opening 130*a* of the movable cutter 130 is in communication with the hole 128*a* of the fixed cutter 128 (this state may be termed "communicated state" hereinbelow) as shown in FIG. 6, the wire W extending from the guide 82 can pass through the hole 128*a* of the fixed cutter 128 and the opening 130*a* of the movable cutter 130. Then, when the movable cutter 130 is rotated in a direction D3 shown in FIG. 6 relative to the fixed cutter 128 (this state may be termed "cutting state" hereinbelow), the wire W is cut by the fixed cutter 128 and the movable cutter 130.

Figure 13:
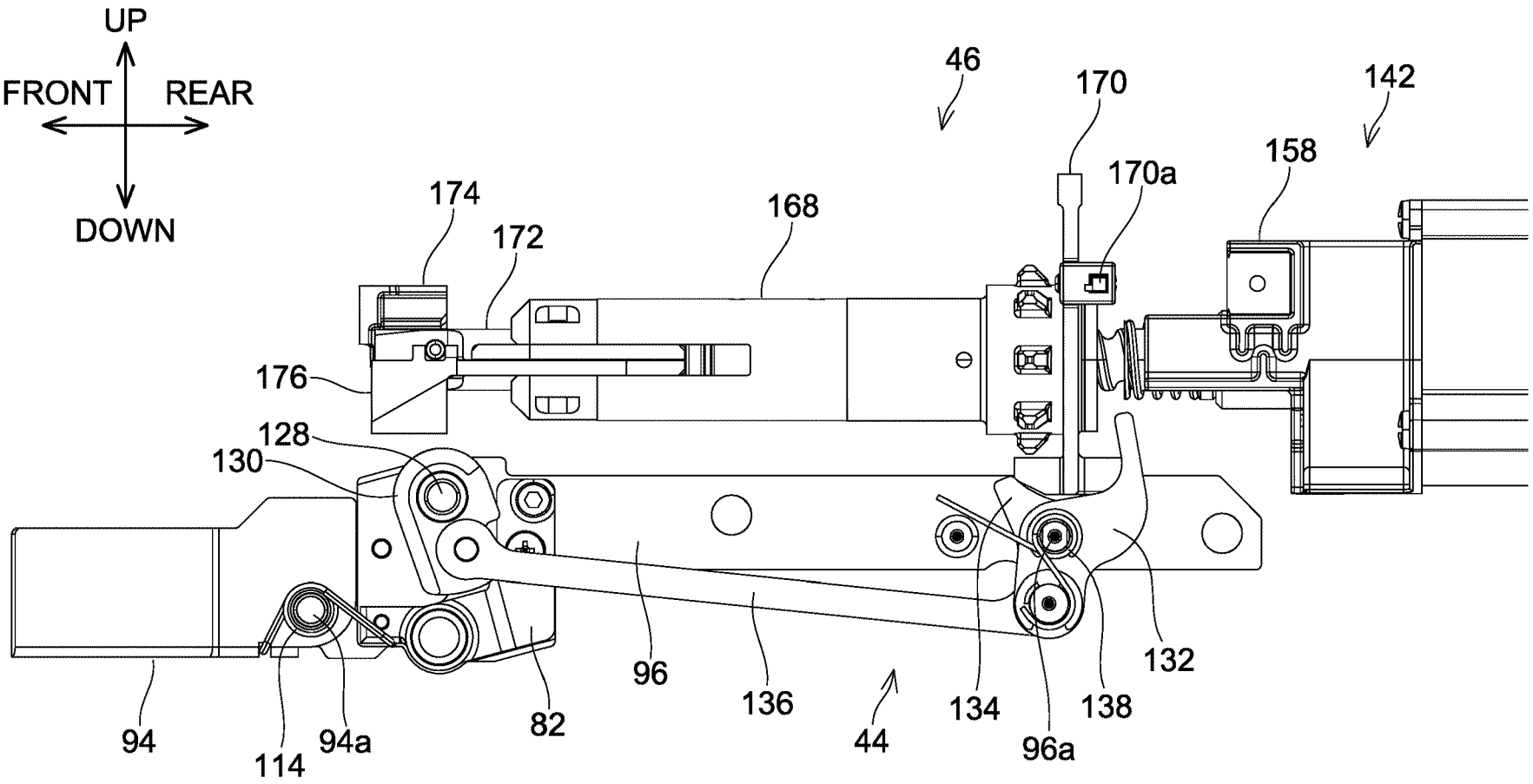
FIG. 13 is a side view showing that the fixed cutter 128 and the movable cutter 130 are in a cutting state in the wire cutting mechanism 44 of the rebar tying machine 2 according to the embodiment.

As shown in FIG. 12, the first lever 132 and the second lever 134 are disposed near a rear end of the lower base 96. The first lever 132 and the second lever 134 are fixed to each other. The first lever 132 and the second lever 134 are supported by the lower base 96 such that they are swingable about a swing shaft 96*a*. Lower ends of the first lever 132 and the second lever 134 are rotatably coupled to a rear end of the link 136. A front end of the link 136 is rotatably coupled to a lower end of the movable cutter 130. The rear end of the link 136 is biased forward by the torsion spring 138. When the first lever 132 and the second lever 134 are swung in a direction that brings their lower ends forward as shown in FIG. 12, the link 136 is moved forward and the fixed cutter 128 and the movable cutter 130 are thereby brought into the communicated state. When the first lever 132 and the second lever 134 are swung in a direction that brings their lower ends rearward as shown in FIG. 13, the link 136 is moved rearward and the fixed cutter 128 and the movable cutter 130 are thereby brought into the cutting state.

(Configuration of Wire Twisting Mechanism 46)

Figure 14:
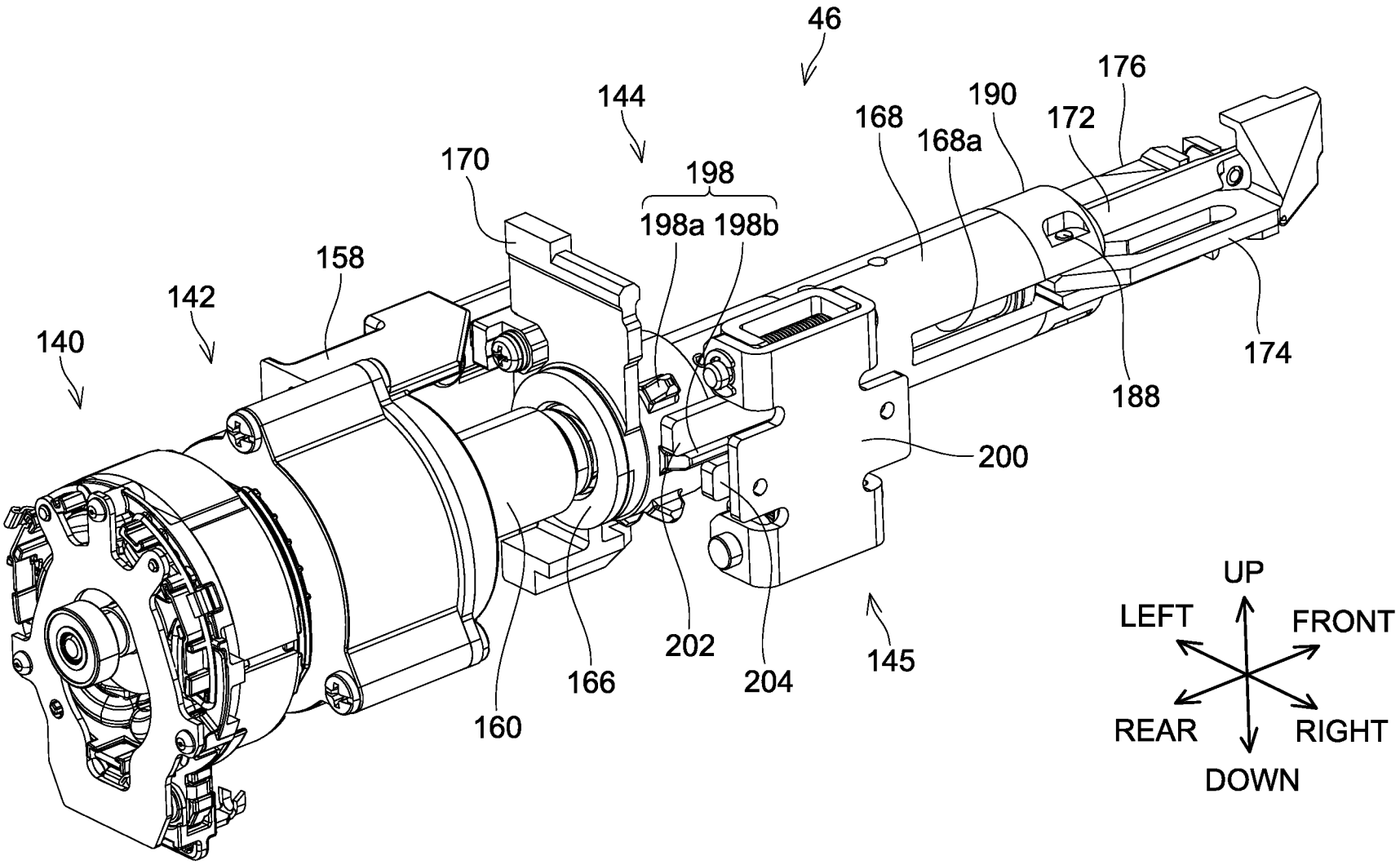
FIG. 14 is a perspective view of a wire twisting mechanism 46 of the rebar tying machine 2 according to the embodiment.

As shown in FIG. 14, the wire twisting mechanism 46 comprises a twisting motor 140, a speed reducer 142, a retainer 144, and a rotation restrictor 145. The twisting motor 140 is connected to the control circuit board 36 via wiring (not shown). The twisting motor 140 is driven by electric power supplied from the battery pack B. The twisting motor 140 is controlled by the control circuit board 36. The speed reducer 142 is configured to reduce the rotational speed of the twisting motor 140, for example, by a planetary gear mechanism, and transmit it to the retainer 144. The twisting motor 140 and the speed reducer 142 are fixed to the right housing 18 and the left housing 20.

The twisting motor 140 is a brushless motor, for example. The twisting motor 140 has a similar configuration to that of the feeding motor 50. As shown in FIG. 5, the twisting motor 140 comprises a stator 150 that includes teeth 148 on which coils 146 are wound, a rotor 152 disposed inside the stator 150, and a sensor board 154 fixed to the stator 150. The stator 150 is constituted of a magnetic body. The rotor 152 comprises a permanent magnet in which magnetic poles are circumferentially arranged. The sensor board 154 comprises a Hall sensor 156. The Hall sensor 156 comprises a first Hall element 156*a*, a second Hall element 156*b*, and a third Hall element 156*c*. The first Hall element 156*a*, the second Hall element 156*b*, and the third Hall element 156*c* are configured to sense magnetic force from the rotor 152.

Figure 15:
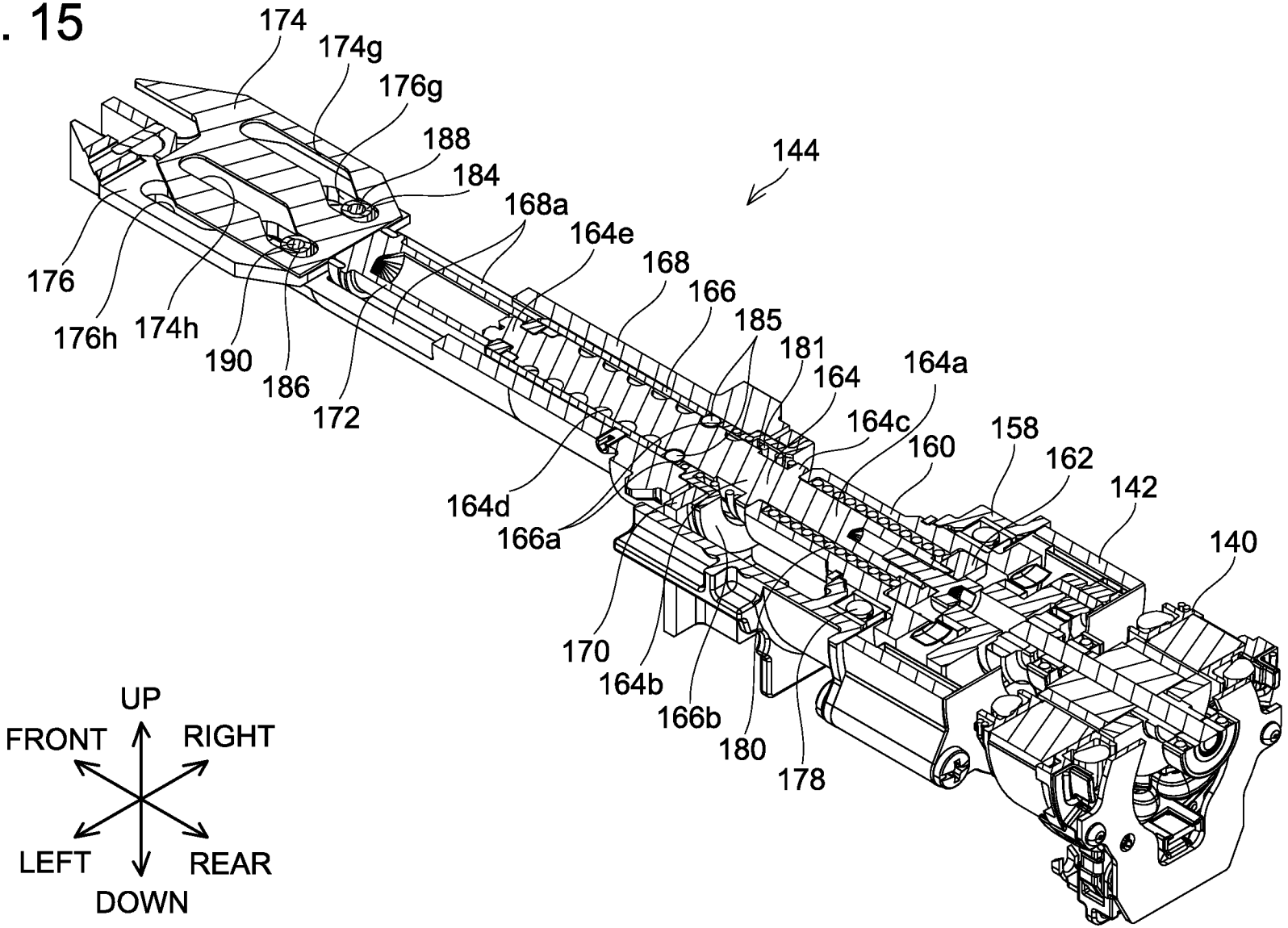
FIG. 15 is a cross sectional view showing a twisting motor 140, a speed reducer 142, and a retainer 144 of the wire twisting mechanism 46 of the rebar tying machine 2 according to the embodiment.

As shown in FIG. 15, the retainer 144 comprises a bearing box 158, a carrier sleeve 160, a clutch plate 162, a screw shaft 164, an inner sleeve 166, an outer sleeve 168, a push plate 170, a clamp shaft 172, a right clamp 174, and a left clamp 176.

The bearing box 158 is fixed to the speed reducer 142. The bearing box 158 supports the carrier sleeve 160 via a bearing 178 such that the carrier sleeve 160 is rotatable. Rotation is transmitted to the carrier sleeve 160 from the speed reducer 142. When the twisting motor 140 rotates forward, the carrier sleeve 160 is rotated counterclockwise as seen from the rear. When the twisting motor 140 rotates in reverse, the carrier sleeve 160 is rotated clockwise as seen from the rear.

Figure 16:
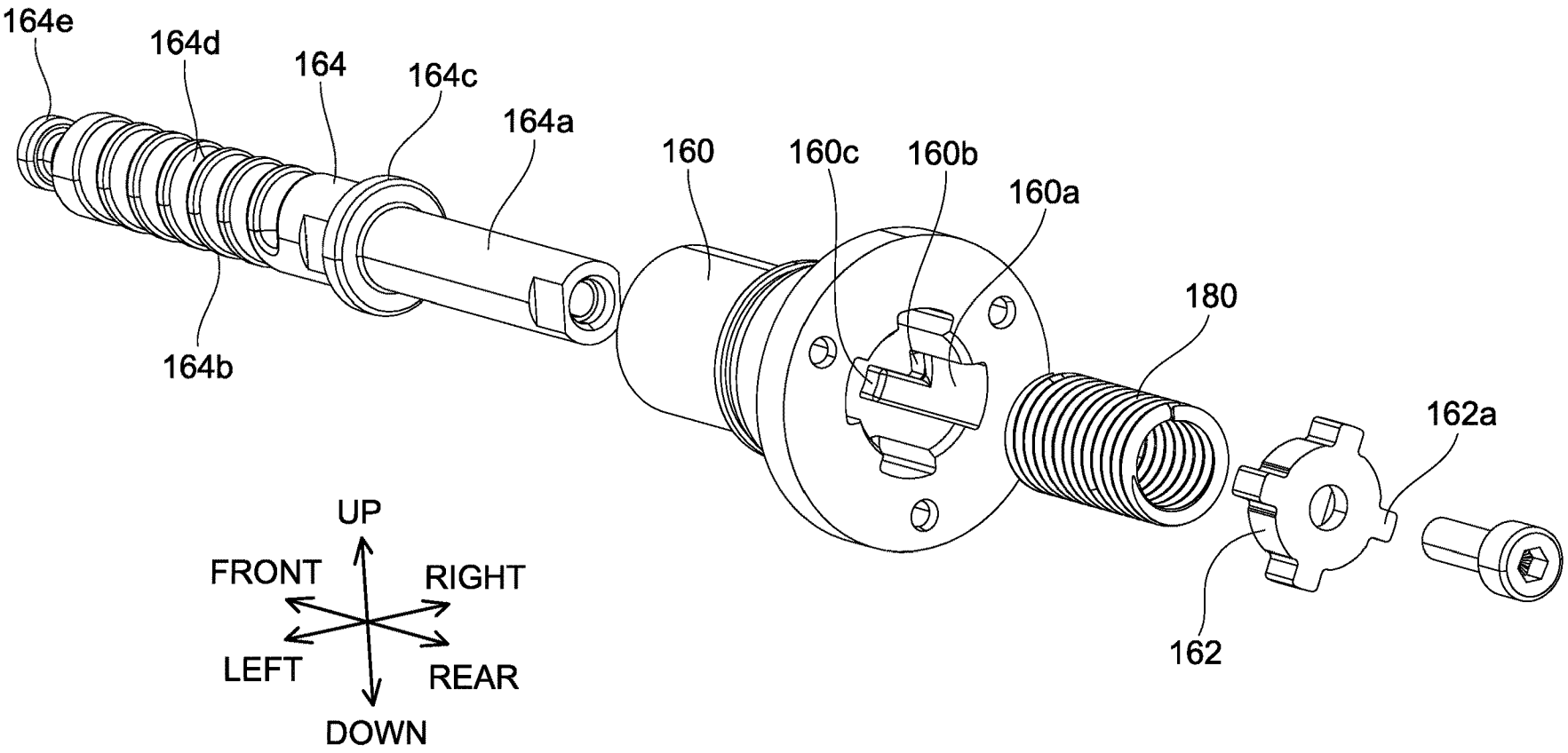
FIG. 16 is an exploded perspective view showing a carrier sleeve 160, a clutch plate 162, and a screw shaft 164 of the wire twisting mechanism 46 of the rebar tying machine 2 according to the embodiment.

As shown in FIG. 16, the carrier sleeve 160 has a clutch groove 160*a* in a rear portion of its inner surface and the clutch groove 160*a* extends in the front-rear direction. The clutch groove 160*a* includes a first wall 160*b* and a second wall 160*c* at its front end. A distance from a rear end of the carrier sleeve 160 to the first wall 160*b* in the front-rear direction is shorter than a distance from the rear end of the carrier sleeve 160 to the second wall 160*c* in the front-rear direction. The clutch plate 162 is housed inside the carrier sleeve 160. The clutch plate 162 includes a clutch piece 162*a* corresponding to the clutch groove 160*a*. The clutch plate 162 is biased rearward relative to the carrier sleeve 160 by a compression spring 180 housed inside the carrier sleeve 160. Normally, the clutch plate 162 is allowed to move forward, relative to the carrier sleeve 160, until the clutch piece 162*a* contacts the first wall 160*b* of the clutch groove 160*a*. When the wire W is twisted, the carrier sleeve 160 is rotated counterclockwise as seen from the rear relative to the clutch plate 162, and thus the data plate 162 is allowed to move forward, relative to the carrier sleeve 160, until the clutch piece 162*a* contacts the second wall 160*c* of the clutch groove 160*a*.

A rear portion 164*a* of the screw shaft 164 is inserted into the carrier sleeve 160 from a front end of the carrier sleeve 160 and is fixed to the clutch plate 162. The screw shaft 164 includes a radially protruding flange 164*c* between the rear portion 164*a* and a front portion 164*b* of the screw shaft 164. The front portion 164*b* of the screw shaft 164 has a spiral ball groove 164*d* in its outer surface. The screw shaft 164 includes an engagement portion 164*e* at its front end, and a diameter of the engagement portion 164*e* is smaller than that of the front portion 164*b*.

As shown in FIG. 15, a compression spring 181 is attached to the front portion 164*b* of the screw shaft 164. The front portion 164*b* of the screw shaft 164 is inserted into the inner sleeve 166 from a rear end of the inner sleeve 166. The inner sleeve 166 has a ball hole 166*a* configured to hold balls 185 therein. The balls 185 fit in the ball groove 164*d* of the screw shaft 164. The inner sleeve 166 includes a radially protruding flange 166*b* at its rear end. The inner sleeve 166 is inserted into the outer sleeve 168 from a rear end of the outer sleeve 168. The outer sleeve 168 is fixed to the inner sleeve 166. In the case where the rotation restrictor 145 (see FIG. 14) allows the outer sleeve 168 to rotate, the inner sleeve 166 and the outer sleeve 168 are integrally rotated when the screw shaft 164 rotates. In the case where the rotation restrictor 145 (see FIG. 14) prohibits the outer sleeve 168 from rotating, the inner sleeve 166 and the outer sleeve 168 are moved in the front-rear direction relative to the screw shaft 164 when the screw shaft 164 rotates. Specifically, when the screw shaft 164 is rotated counterclockwise as seen from the rear in response to the twisting motor 140 rotating forward, the inner sleeve 166 and the outer sleeve 168 are moved forward relative to the screw shaft 164. When the screw shaft 164 is rotated clockwise as seen from the rear in response to the twisting motor 140 rotating in reverse, the inner sleeve 166 and the outer sleeve 168 are moved rearward relative to the screw shaft 164. The push plate 170 is disposed between the rear end of the outer sleeve 168 and the flange 166*b* of the inner sleeve 166. Thus, the push plate 170 is also moved in the front-rear direction when the inner sleeve 166 and the outer sleeve 168 are moved in the front-rear direction. The outer sleeve 168 has slits 168*a* in its front portion and the slits 168*a* extend rearward from a front end of the outer sleeve 168.

Figure 17:
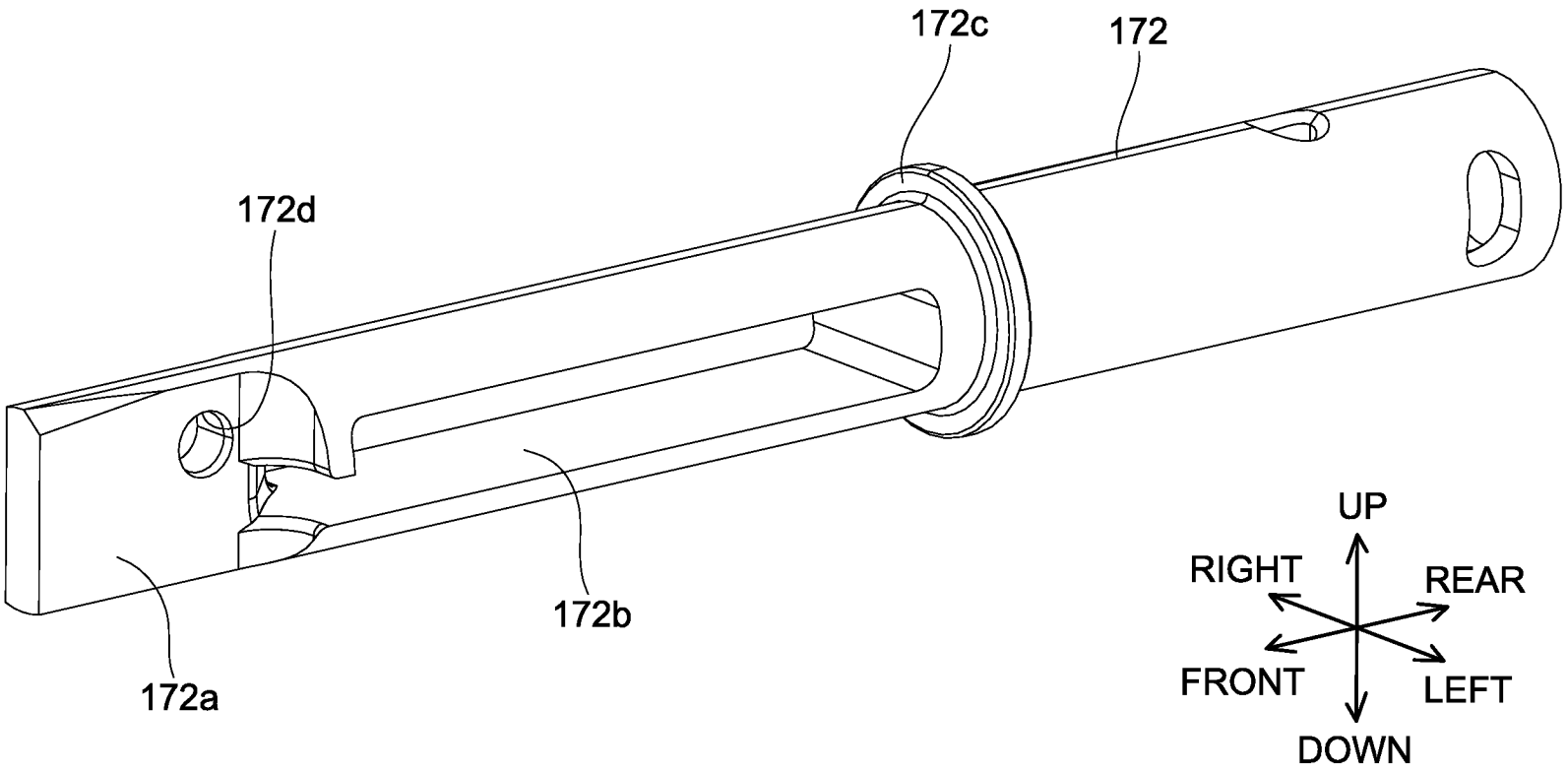
FIG. 17 is a perspective view of a clamp shaft 172 of the wire twisting mechanism 46 of the rebar tying machine 2 according to the embodiment.

The clamp shaft 172 is inserted into the inner sleeve 166 from a front end of the inner sleeve 166. The engagement portion 164*e* of the screw shaft 164 is inserted at a rear end of the clamp shaft 172. The clamp shaft 172 is fixed to the screw shaft 164. As shown in FIG. 17, the clamp shaft 172 includes a flat-plate portion 172*a*, an opening 172*b*, and a flange 172*c*. The flat-plate portion 172*a* is disposed at a front end of the clamp shaft 172 and has a substantially flat-plate shape along the front-rear direction and the up-down direction. The flat-plate portion 172*a* has a hole 172*d* in which a pin 182 (see FIG. 18) fits. The opening 172*b* is disposed rearward of the flat-plate portion 172*a*. The opening 172*b* penetrates the clamp shaft 172 in the right-left direction and extends in the front-rear direction. The flange 172*c* is disposed rearward of the opening 172*b* and protrudes radially.

Figure 18:
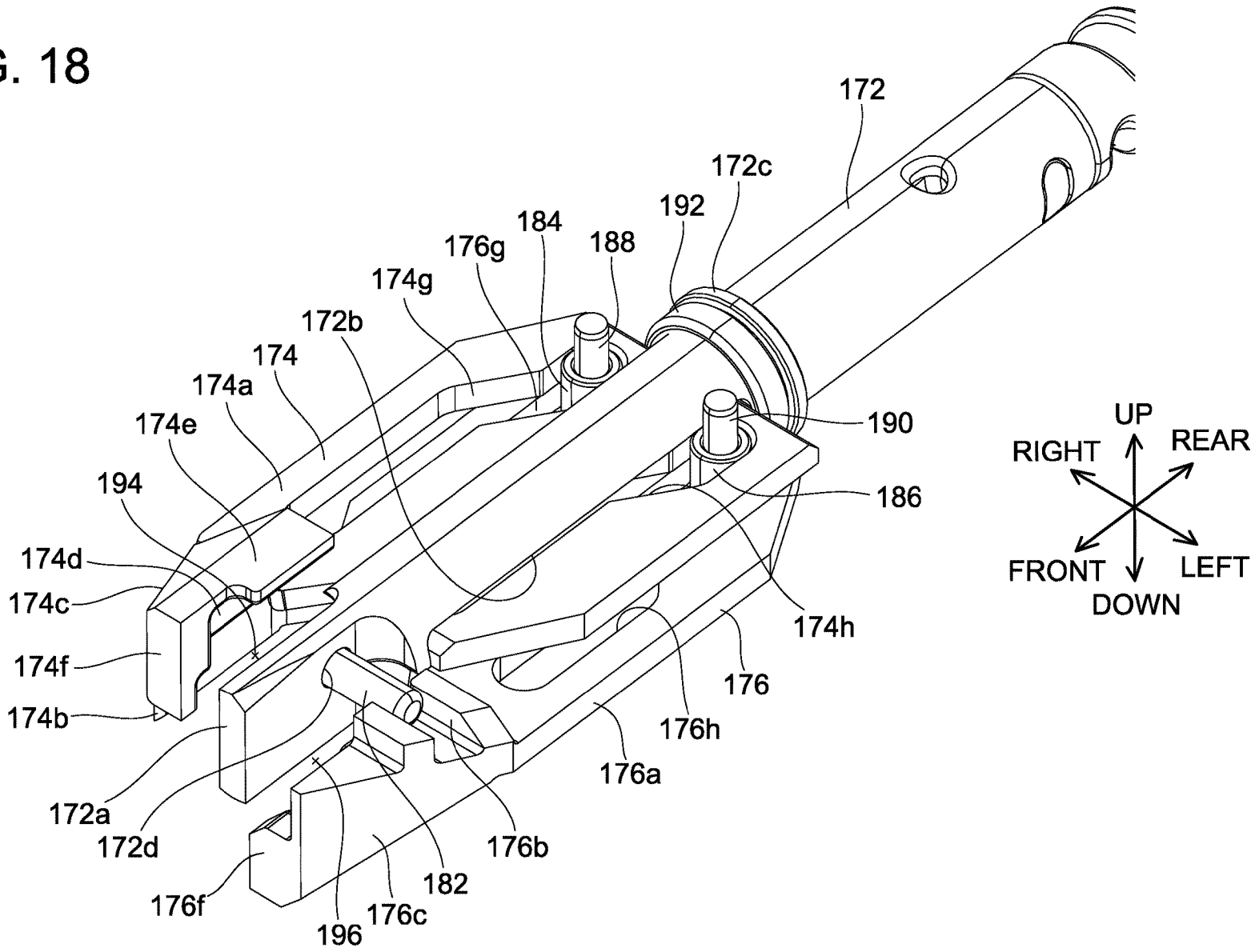
FIG. 18 is a perspective view of the clamp shaft 172 with a right clamp 174 and a left clamp 176 attached thereto in the wire twisting mechanism 46 of the rebar tying machine 2 according to the embodiment.

As shown in FIG. 18, the right clamp 174 is attached to the clamp shaft 172 with the right clamp 174 passing through the opening 172*b* of the clamp shaft 172 from the right side to the left side of the opening 172*b*. Below the right clamp 174, the left clamp 176 is attached to the clamp shaft 172 with the left clamp 176 passing through the opening 172*b* of the clamp shaft 172 from the left side to the right side of the opening 172*b*.

Figure 19:
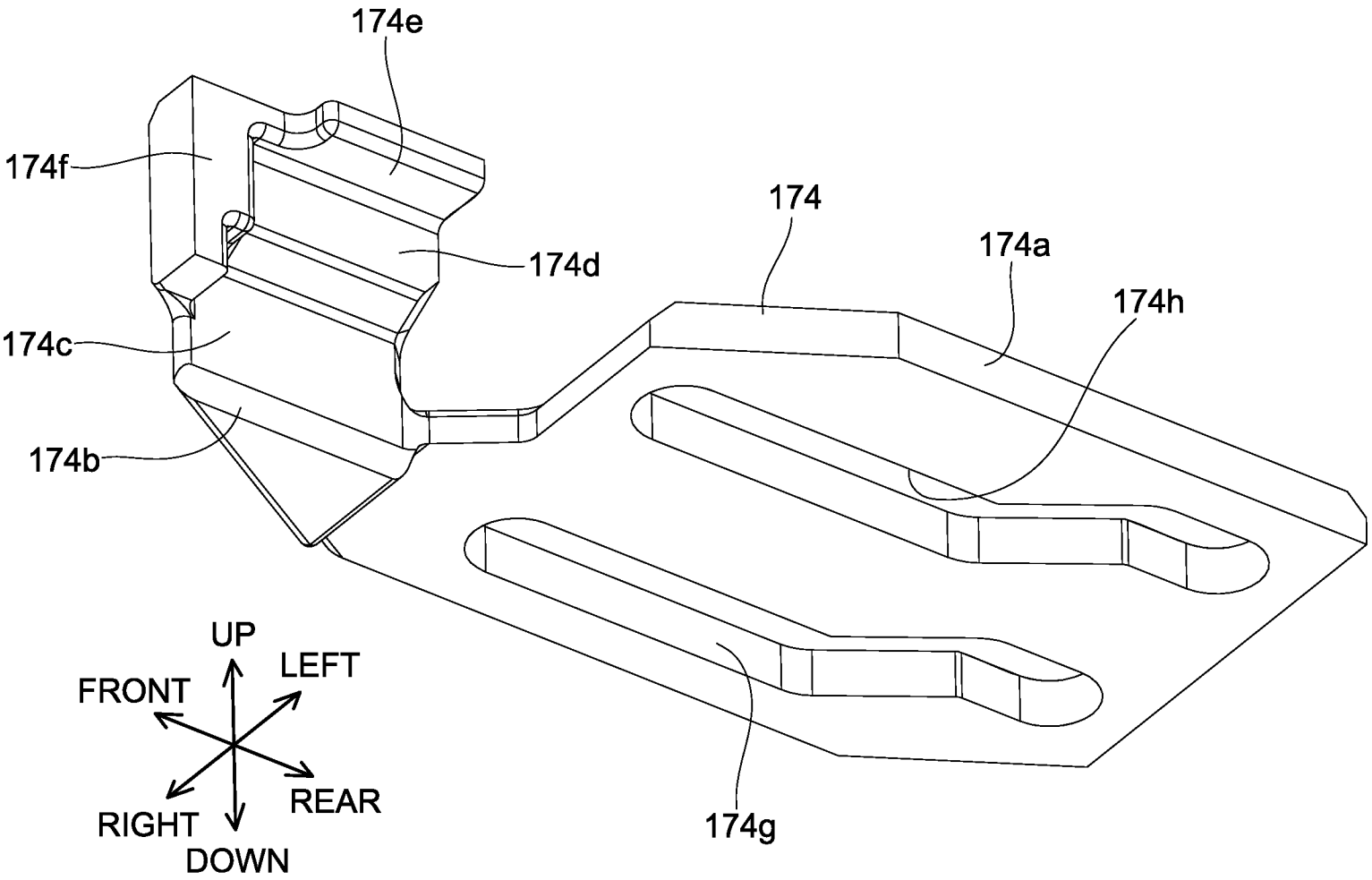
FIG. 19 is a perspective view of the right clamp 174 of the wire twisting mechanism 46 of the rebar tying machine 2 according to the embodiment.

As shown in FIG. 19, the right clamp 174 comprises a base 174*a*, a downward protrusion 174*b*, an upward protrusion 174*c*, a contact portion 174*d*, an upper guard 174*e*, and a front guard 174*f*. The base 174*a* has a substantially flat-plate shape along the front-rear direction and the right-left direction. The downward protrusion 174*b* is disposed at a right front end of the base 174*a* and protrudes downward from the base 174*a*. The upward protrusion 174*c* is disposed at the right front end of the base 174*a* and protrudes upward from the base 174*a*. The contact portion 174*d* protrudes leftward from an upper end of the upward protrusion 174*c*. The upper guard 174*e* protrudes leftward from an upper end of the contact portion 174*d*. The front guard 174*f* protrudes leftward from ends of the upward protrusion 174*e* and the contact portion 174*d*. The base 174*a* has cam holes 174*g* and 174*h*. Each of the earn holes 174*g* and 174*h* extends forward from its rear end, bends and extends diagonally forward right, and then bends again and extends forward.

Figure 20:
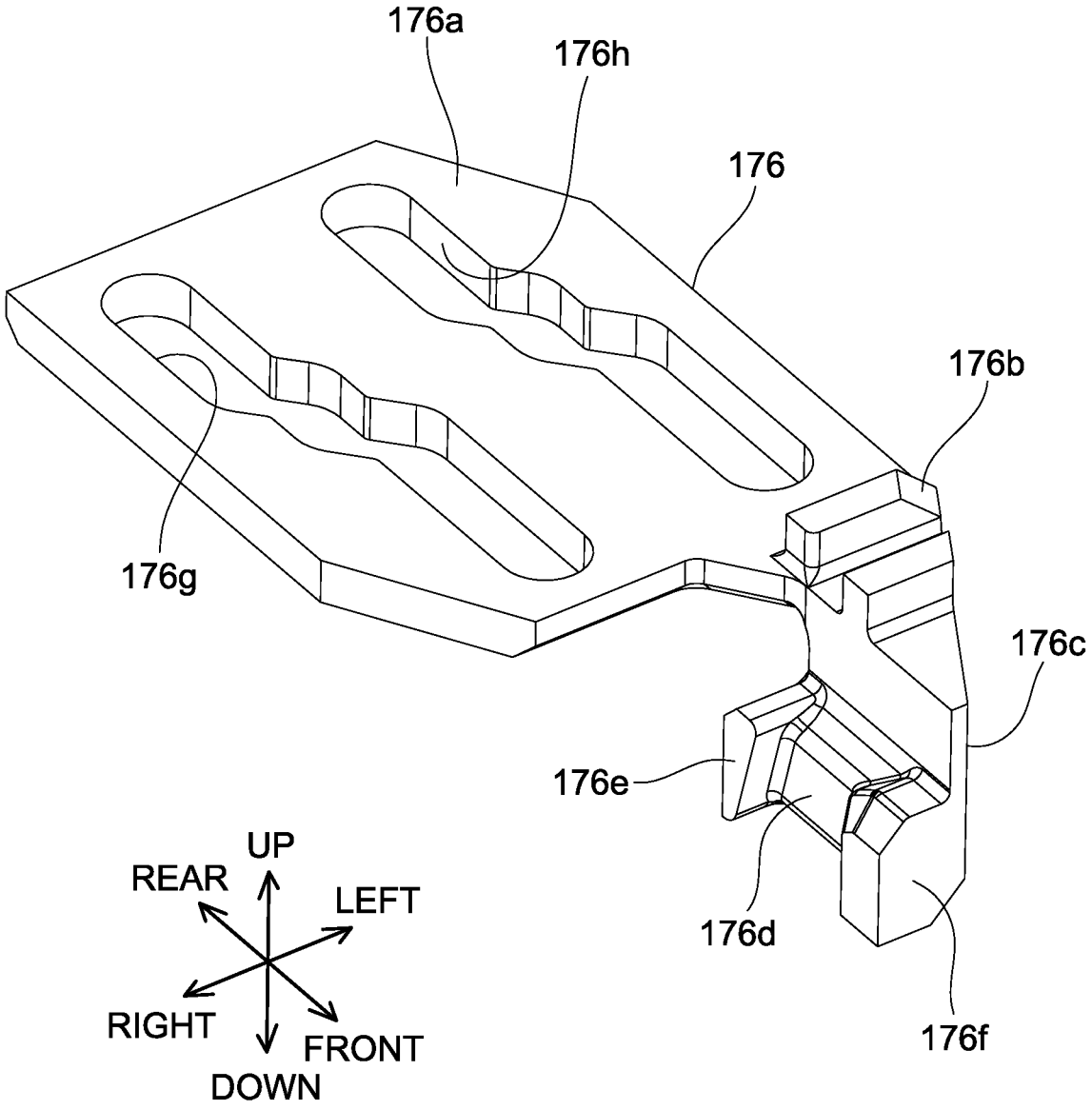
FIG. 20 is a perspective view of the left clamp 176 of the wire twisting mechanism 46 of the rebar tying machine 2 according to the embodiment.

As shown in FIG. 20, the left clamp 176 comprises a base 176*a*, a pin retainer 176*b*, a downward protrusion 176*c*, a contact portion 176*d*, a rear guard 176*e*, and a front guard 176*f*. The base 176*a* has a substantially flat-plate shape along the front-rear direction and the right-left direction. The pin retainer 176*b* is disposed at a left front end of the base 176*a* and retains the pin 182 (see FIG. 18) above the base 176*a* such that the pin 182 is slidable. The downward protrusion 176*c* is disposed at the left front end of the base 176*a* and protrudes downward from the base 176*a*. The contact portion 176*d* protrudes rightward from a lower end of the downward protrusion 176*c*. The rear guard 176*e* protrudes rightward from a rear end of the contact portion 176*d*. The front guard 174*f* protrudes rightward from a front end of the contact portion 176*d*. The base 176*a* has cam holes 176*g* and 176*h*. Each of the cam holes 176*g* and 176*h* extends forward from its rear end, bends and extends diagonally forward left, bends again and extends forward, bends and extends diagonally forward left again, and then bends and extends forward.

As shown in FIG. 18, in the state where the right clamp 174 and the left clamp 176 are attached to the clamp shaft 172, a cam sleeve 184 penetrates the cam holes 174*g* and 176*g* and a cam sleeve 186 penetrates the cam holes 174*h* and 176*h*. Further, a support pin 188 penetrates the cam sleeve 184 and a support pin 190 penetrates the cam sleeve 186. A cushion 192 that has a substantially annular shape is attached between the right clamp 174 and the left clamp 176 and the flange 172*c* of the clamp shaft 172.

As shown in FIG. 14, in the state where the clamp shaft 172 is attached to the inner sleeve 166, the right clamp 174 and the left clamp 176 are in the slits 168*a* of the outer sleeve 168 and the support pins 188 and 190 are coupled with the outer sleeve 168. When the clamp shaft 172 is moved in the front-rear direction relative to the outer sleeve 168, the cam sleeve 184 attached to the support pin 188 is moved within the cam holes 174*g* and 176*g* in the front-rear direction and the cam sleeve 186 attached to the support pin 190 is moved within the cam holes 174*h* and 176*h* in the front-rear direction, and thereby the right clamp 174 and the left clamp 176 are moved in the right-left direction.

In an initial state in which the clamp shaft 172 protrudes forward from the outer sleeve 168, the right clamp 174 is positioned furthest to the right from the clamp shaft 172. In this state, as shown in FIG. 18, a right wire passage 194 through which the wire W can pass is defined between the upward protrusion 174*c* of the right clamp 174 and the flat-plate portion 172*a* of the clamp shaft 172, and the upper guard 174*c* covers the right wire passage 194 from above. This state of the right clamp 174 may be termed a fully-open state. When the outer sleeve 168 is moved forward relative to the clamp shaft 172 in that state, the right clamp 174 is moved leftward toward the clamp shaft 172. In this state, the wire W is held between a lower end of the contact portion 174*d* of the right clamp 174 and an upper end of the flat-plate portion 172*a* of the clamp shaft 172 and a front end of the right wire passage 194 is covered by the front guard 174*f*. This state of the right clamp 174 may be termed a fully-closed state.

In the initial state in which the clamp shaft 172 protrudes forward from the outer sleeve 168, the left clamp 176 is positioned furthest to the left from the clamp shaft 172. In this state, a left wire passage 196 through which the wire W can pass is defined between the downward protrusion 176*c* of the left clamp 176 and the flat-plate portion 172*a* of the clamp shaft 172. This state of the left clamp 176 may be termed a fully-open state. When the outer sleeve 168 is moved forward relative to the clamp shaft 172 in that state, the left clamp 176 is moved rightward toward the clamp shaft 172. The wire W can still pass through the left wire passage 196 in this state, while a rear end of the left wire passage 196 is covered by the rear guard 176*e* and a front end of the left wire passage 196 is covered by the front guard 176*f*. This state of the left clamp 176 may be termed a half-open state. When the outer sleeve 168 is moved further forward relative to the clamp shaft 172, the left clamp 176 is moved further rightward toward the clamp shaft 172. In this state, the wire W is held between an upper end of the contact portion 176*d* of the left clamp 176 and a lower end of the flat-plate portion 172*a* of the clamp shaft 172. This state of the left clamp 176 may be termed a fully-closed state.

The wire W passes through the left wire passage 196 of the wire twisting mechanism 46 to proceed from the fixed cutter 128 (see FIG. 6) of the wire cutting mechanism 44 to the upper wire passage 102 (see FIG. 6) of the wire guiding mechanism 40. Thus, when seen after the wire W has been cut by the wire cutting mechanism 44 with the left clamp 176 in the fully-closed state, a proximal end of the wire W wound around the rebars R is held by the left clamp 176 and the clamp shaft 172. The size of the left wire passage 196 is enough for multiple wires W to pass therethrough and proximal ends of the multiple wires W can be held by the left, clamp 176 and the clamp shaft 172.

The wire W passes through the right wire passage 194 of the wire twisting mechanism 46 after having passed the lower wire passage 112 of the wire guiding mechanism 40 and been directed upward. Thus, when the right clamp 174 is in the fully-closed state, a distal end of the wire W wound around the rebars R is held by the right clamp 174 and the clamp shaft 172. The size of the right wire passage 194 is enough for multiple wires W to pass therethrough and distal ends of the multiple wires W can be held by the right clamp 174 and the clamp shaft 172.

Figure 21:
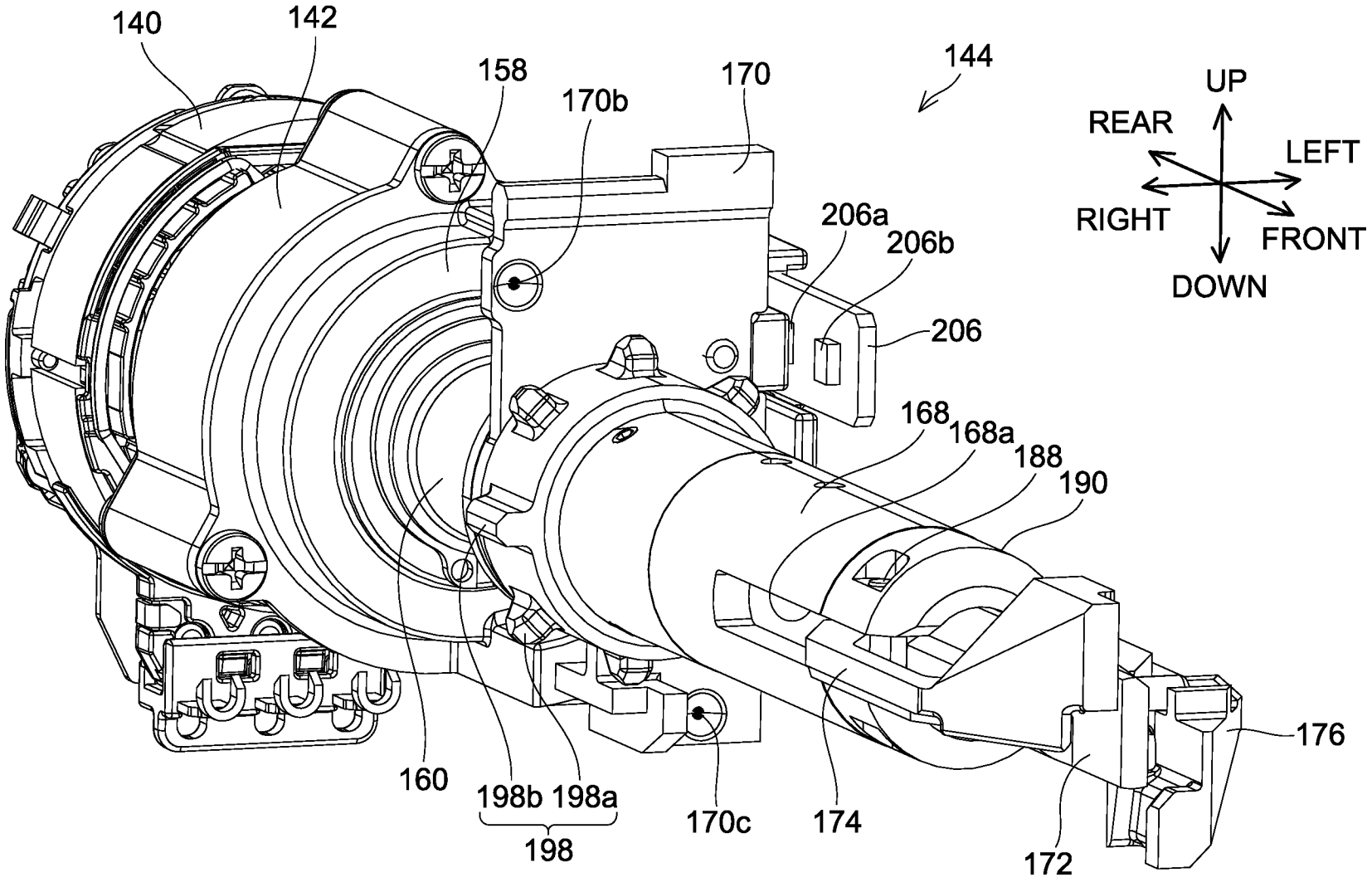
FIG. 21 is a perspective view of the twisting motor 140, the speed reducer 142, and the retainer 144 of the wire twisting mechanism 46 of the rebar tying machine 2 according to the embodiment.

As shown in FIG. 21, the outer sleeve 168 includes fins 198 on an outer surface of its rear portion. The fins 198 extend in the front-rear direction. In the present embodiment, eight fins 198 are arranged on the outer surface of the outer sleeve 168 with intervals of 45 degrees from each other. Further, in the present embodiment, the fins 198 comprise seven short fins 198*a* and one long fin 198*b*. The length of the long fin 198*b* in the front-rear direction is greater than the length of the short fins 198*a* in the front-rear direction. With respect to the front-rear direction, the position of a rear end of the long fin 198*b* is coincident with the positions of rear ends of the short fins 198*a*. With respect to the front-rear direction, the position of a front end of the long fin 198*b* is located forward of the positions of front ends of the short fins 198*a*.

Figure 22:
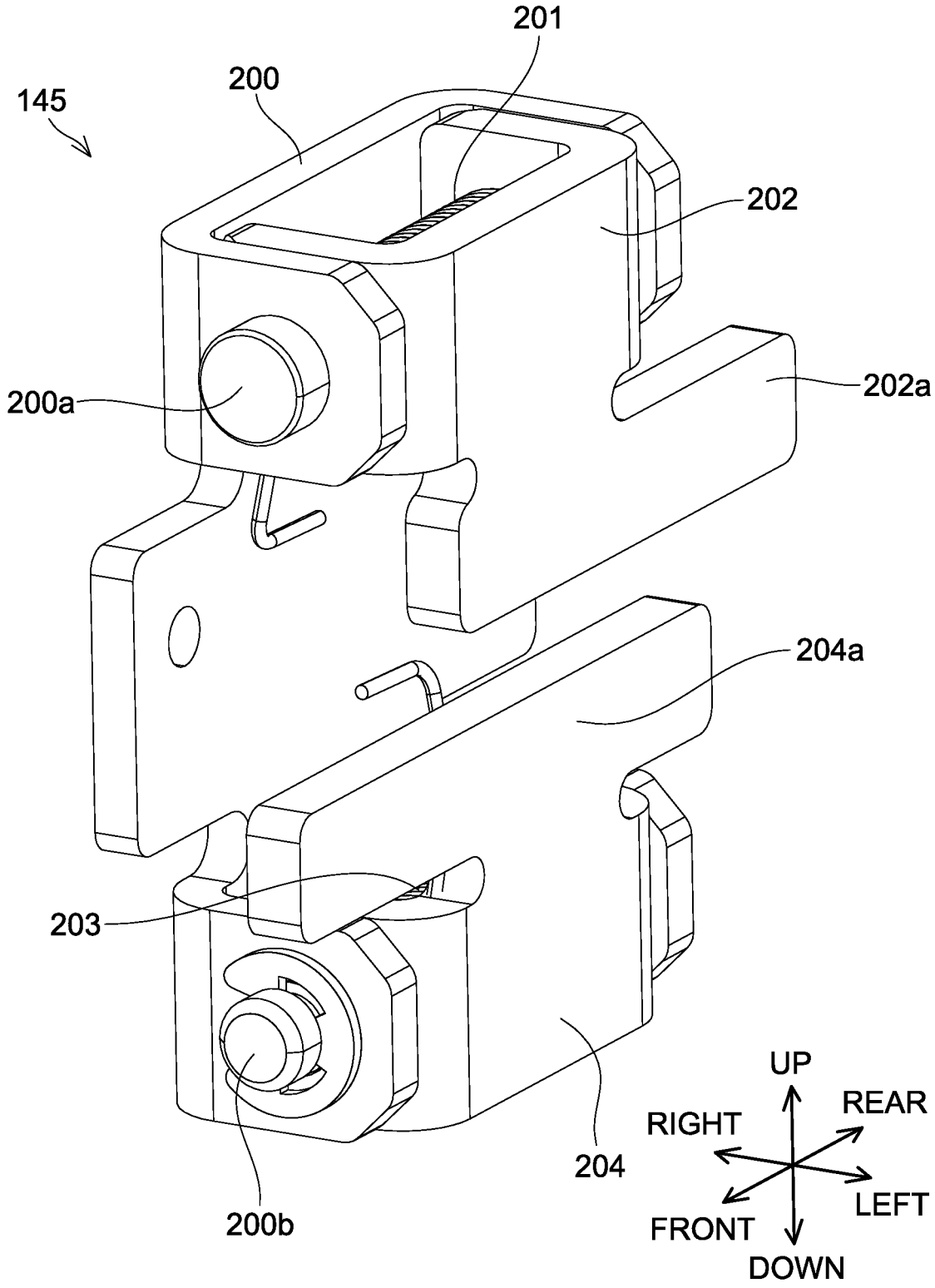
FIG. 22 is a perspective view of a rotation restrictor 145 of the wire twisting mechanism 46 of the rebar tying machine 2 according to the embodiment.

As shown in FIG. 14, the rotation restrictor 145 is disposed to correspond to the fins 198 of the outer sleeve 168. The rotation restrictor 145 is configured to allow or prohibit the rotation of the outer sleeve 168 in cooperation with the fins 198. As shown in FIG. 22, the rotation restrictor 145 comprises a base 200, an upper stopper 202, a lower stopper 204, and torsion springs 201 and 203. The base 200 is fixed to the right housing 18. The upper stopper 202 is swingably supported by an upper portion of the base 200 via a swing shaft 200*a*. The upper stopper 202 comprises a restriction piece 202*a*. The restriction piece 202*a* is disposed at a lower portion of the upper stopper 202. The torsion spring 201 biases the restriction piece 202*a* in an outwardly opening direction (i.e., in a direction that brings the restriction piece 202*a* separated away from the base 200). The lower stopper 204 is swingably supported by a lower portion of the base 200 via a swing shaft 200*b*. The lower stopper 204 comprises a restriction piece 204*a*. The restriction piece 204*a* is disposed at an upper portion of the lower stopper 204. A rear end of the restriction piece 204*a* is located forward of a rear end of the restriction piece 202*a*. A front end of the restriction piece 204*a* is located forward of a front end of the restriction piece 202*a*. The torsion spring 203 biases the restriction piece 204*a* in an outwardly opening direction (i.e., in a direction that brings the restriction piece 204*a* separated away from the base 200).

When the screw shaft 164 is rotated counterclockwise as seen from the rear in response to the twisting motor 140 rotating forward, the rotation of the outer sleeve 168 is prohibited by the upper stopper 202 by the restriction piece 202*a* of the upper stopper 202 contacting one of the fins 198 of the outer sleeve 168. To the contrary, when the screw shaft 164 is rotated clockwise as seen from the rear in response to the twisting motor 140 rotating in reverse, one of the fins 198 of the outer sleeve 168 contacts the restriction piece 202*a* and pushes in the restriction piece 202*a*. In this case, the upper stopper 202 does not prohibits the rotation of the outer sleeve 168.

When the screw shaft 164 is rotated counterclockwise as seen from the rear in response to the twisting motor 140 rotating forward, one of the fins 198 of the outer sleeve 168 contacts the restriction piece 204*a* of the lower stopper 204 and pushes in the restriction piece 204*a*. In this case, the lower stopper 204 does not prohibit the rotation of the outer sleeve 168. To the contrary, when the screw shaft 164 is rotated clockwise as seen from the rear, the rotation of the outer sleeve 168 is prohibited by the lower stopper 204 by the restriction piece 204*a* contacting one of the fins 198 of the outer sleeve 168.

As shown in FIGS. 7 and 8, an upper end of the push plate 170 is coupled to a rear end of the slide plate 110 of the wire guiding mechanism 40. Thus, when the push plate 170 of the wire twisting mechanism 46 is moved in the front-rear direction, the slide plate 110 of the wire guiding mechanism 40 is also moved in the front-rear direction accordingly.

As shown in FIGS. 12 and 13, a lower end of the push plate 170 is positioned to correspond to the first lever 132 and the second lever 134 of the wire cutting mechanism 44. Thus, when the push plate 170 is moved forward and rotates the second lever 134 forward by contacting it, the fixed cutter 128 and the movable cutter 130 of the wire cutting mechanism 44 are brought into the cutting state. When the push plate 170 is moved rearward and rotates the first lever 132 rearward by contacting it, the fixed cutter 128 and the movable cutter 130 of the wire cutting mechanism 44 are brought into the communicated state.

The push plate 170 includes a permanent magnet 170*a*. As shown in FIG. 21, the bearing box 158 includes a sensor board 206 corresponding to the permanent magnet 170*a*. The sensor board 206 comprises two magnetic sensors 206*a* and 206*b* configured to detect magnetism from the permanent magnet 170*a*. The magnetic sensor 206*a* is disposed to face the permanent magnet 170*a* when the wire twisting mechanism 46 is in the initial state. The magnetic sensor 206*b* is disposed to face the permanent magnet 170*a* when the right clamp 174 is in the fully-closed state and the left clamp 176 is in the half-open state in the wire twisting mechanism 46. The sensor board 206 is connected to the control circuit board 36 via wiring (not shown). The permanent magnet 170*a* and the magnetic sensor 206*a* constitute an initial state detection sensor 205 (see FIG. 29). The initial state detection sensor 205 is ON when the wire twisting mechanism 46 is in the initial state, while it is OFF other times. The permanent magnet 170*a* and the magnetic sensor 206*b* constitute a distal end holding detection sensor 207 (see FIG. 29). The distal end holding detection sensor 207 is ON when the right clamp 174 is in the fully-closed state and the left clamp 176 is in the half-open state, while it is OFF other times.

(Configuration of Rebar Pressing Mechanism 48)

Figure 23:
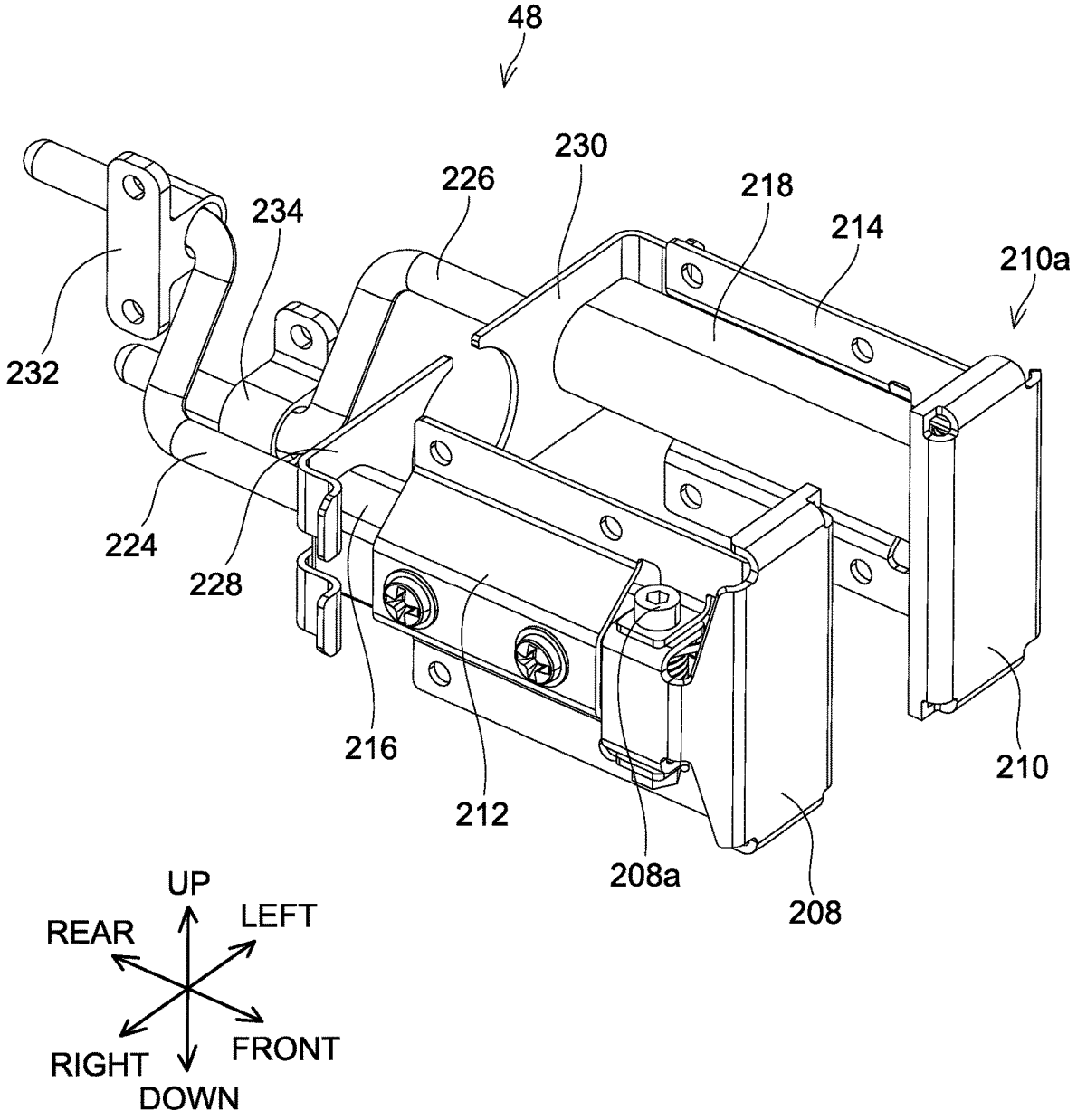
FIG. 23 is a perspective view of a rebar pressing mechanism 48 of the rebar tying machine 2 according to the embodiment.

As shown in FIG. 23, the rebar pressing mechanism 48 comprises contact plates 208 and 210, bases 212 and 214, rod guides 216 and 218, front push rods 220 and 222 (see FIG. 24), rear push rods 224 and 226, guide plates 228 and 230, and rod holders 232 and 234.

Figure 24:
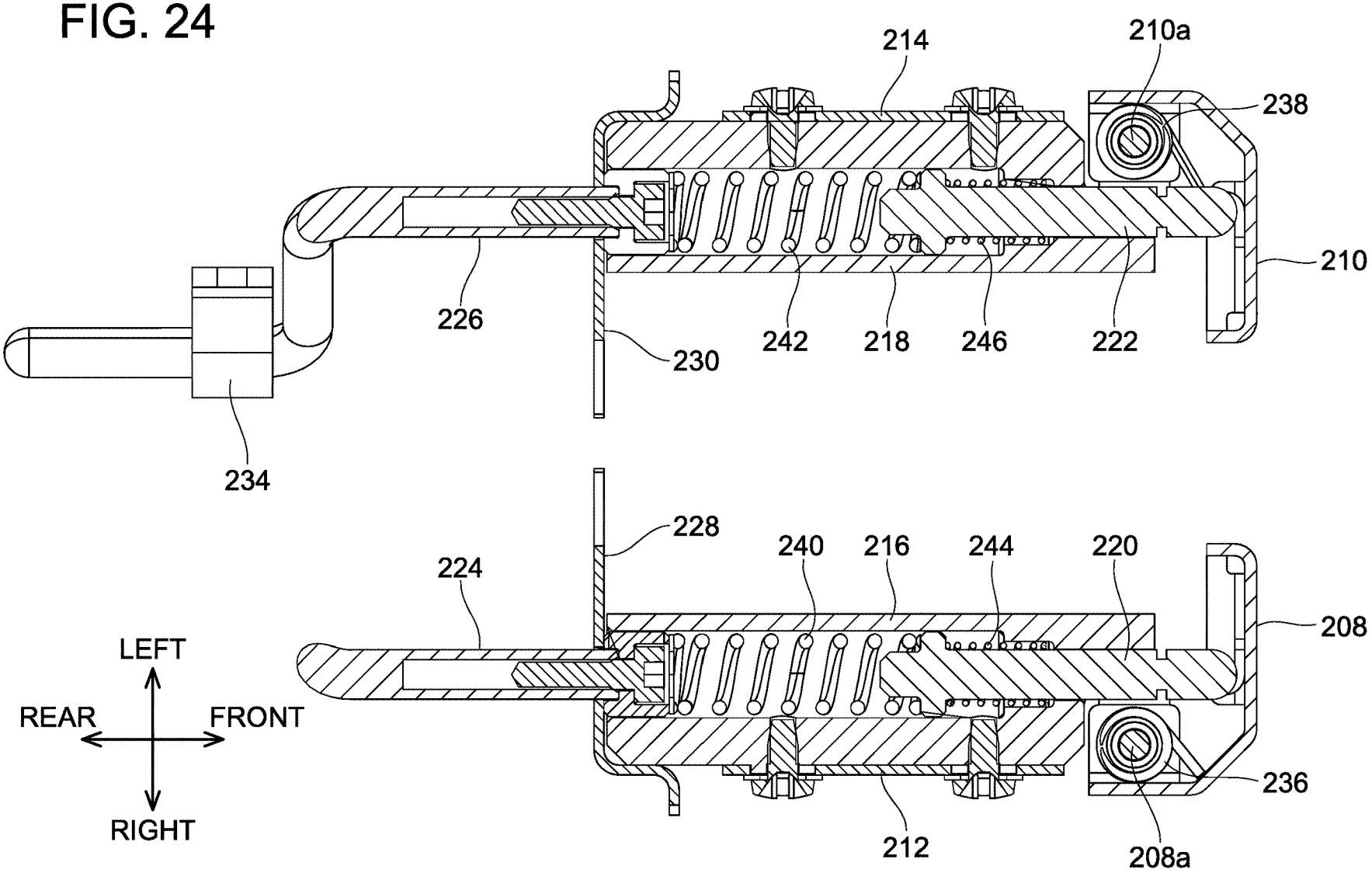
FIG. 24 is a cross sectional view of the rebar pressing mechanism 48 of the rebar tying machine 2 according to the embodiment.

As shown in FIG. 2, the contact plates 208 and 210 are disposed near a front end of the main body 4. As shown in FIG. 23, the contact plates 208 and 210 are supported by the bases 212 and 214 respectively such that they are swingable about swing shafts 208*a* and 210*a* extending in the up-down direction. The base 212 is fixed to the right housing 18. The base 214 is fixed to the left housing 20. As shown in FIG. 24, torsion springs 236 and 238 are attached to the swing shafts 208*a* and 210*a*, respectively. When the contact plates 208 and 210 are rotated in a direction along which they are open forward relative to the bases 212 and 214, the torsion springs 236 and 238 cause, using their elastic restoring forces, biasing forces to act on the contact plates 208 and 210 in a direction along which the contact plates 208 and 210 close rearward relative to the bases 212 and 214.

The rod guides 216 and 218 are fixed to the bases 212 and 214, respectively. The front push rods 220 and 222 are respectively inserted into the rod guides 216 and 218 from rear ends of the rod guides 216 and 218 and protrude forward beyond front ends of the rod guides 216 and 218. Front ends of the front push rods 220 and 222 face rear surfaces of the contact plates 208 and 210, respectively. The rear push rods 224 and 226 are respectively inserted into the rod guides 216 and 218 from the rear ends of the rod guides 216 and 218. A first compression spring 240 and a second compression spring 244 are housed inside the rod guide 216, and a first compression spring 242 and a second compression spring 246 are housed inside the rod guide 218. The first compression springs 240 and 242 couple the front push rods 220 and 222 with the rear push rods 224 and 226, and cause elastic restoring forces when intervals between the front push rods 220 and 222 and the rear push rods 224 and 226 are narrowed. The second compression springs 244 and 246 bias the front push rods 220 and 222 rearward relative to the rod guides 216 and 218. The spring stiffness of the second compression springs 244 and 246 is less than the spring stiffness of the first compression springs 240 and 242. As shown in FIG. 23, the rear push rod 224 extends rearward from its front end, bends and extends diagonally in an upper left direction, and then bends again and extends rearward. The rear push rod 226 extends rearward from its front end, bends and extends diagonally in a lower right direction, and then bends again and extends rearward. The rear push rods 224 and 226 are respectively supported by the guide plates 228 and 230 and the rod holders 232 and 234 such that they are slidable in the front-rear direction. The guide plate 228 and the rod holder 232 are fixed to the right housing 18. The guide plate 230 and the rod holder 234 are fixed to the left housing 20.

As shown in FIG. 21, the push plate 170 of the wire twisting mechanism 46 has rod grooves 170*b* and 170*c* at positions corresponding to the rear push rods 224 and 226. When the push plate 170 is moved forward in the wire twisting mechanism 46, rear ends of the rear push rods 224 and 226 enter the rod grooves 170*b* and 170*c*, respectively. When the push plate 170 is moved further forward, the rear push rods 224 and 226 are pushed forward, and thereby the front push rods 220 and 222 are pushed forward via the first compression springs 240 and 242. The contact plates 208 and 210 are thereby rotated in the direction along which they are open forward and are pressed against the rebars R.

While the wire twisting mechanism 46 is twisting the wire W, the wire W pulls the clamp shaft 172, the right clamp 174, and the left clamp 176 harder toward the rebars R as it is further twisted. At this occasion, if a reaction force acting on the contact plates 208 and 210 from the rebars R is transmitted to the wire twisting mechanism 46 through the right housing 18 and/or the left housing 20, the right housing 18 and/or the left housing 20 may be damaged. In the present embodiment, the reaction force acting on the contact plates 208 and 210 from the rebars R while the wire twisting mechanism 46 is twisting the wire W is transmitted to the push plate 170 of the wire twisting mechanism 46 through the front push rods 220 and 222, the first compression springs 240 and 242, and the rear push rods 224 and 226, and thus damage to the right housing 18 and the left housing 20 can be reduced.

It should be noted that various changes may be made to the above-described configuration of the rebar tying machine 2. For example, in the rebar tying machine 2, the reel holder 10 may be disposed at a rear portion of the main body 4 and the wire feeding mechanism 38 may be disposed between the reel holder 10 of the main body 4 and the wire guiding mechanism 40. Alternatively, the control circuit board 36 may be housed inside the main body 4. Further, the second operation display 34 may be disposed on an outer surface of the main body 4.

(Operation of Rebar Tying Machine 2)

Operation of the rebar tying machine 2 will be described, in the case where the single mode is selected as the operation mode, the rebar tying machine 2 determines, in response to the trigger switch 14 being switched from OFF to ON, that the user has instructed it to tie the rebars R and performs a tying operation. In the case where the multiple mode is selected as the operation mode, the rebar tying machine 2 determines, in response to the trigger switch being ON and the contact detection sensor 125 being switched from OFF to ON, that the user has instructed it to tie the rebars R and performs a tying operation.

Tying operations performed by the rebar tying machine 2 each comprise a feeding process, a distal end holding process, a pull-back process, a proximal portion holding process, a cutting process, a twisting process, and an initial state returning process, which will be described below (Feeding Process)

When the feeding motor 50 rotates forward in an initial state, the wire feeding mechanism 38 feeds out the wire W on the reel 33 by a predetermined length. The distal end of the wire W passes through, in sequence, the fixed cutter 128, the movable cutter 130, the left wire passage 196, the upper wire passage 102, the lower wire passage 112, and the right wire passage 194. In this way, the wire W is wound around the rebars R in form of a loop. When this feeding of the wire W is completed, the feeding motor 50 stops.

(Distal End Holding Process)

When the twisting motor 140 rotates forward after the feeding process has finished, the screw shaft 164 is rotated counterclockwise. At this occasion, the outer sleeve 168 is prohibited by the rotation restrictor 145 from rotating counterclockwise. Thus, the outer sleeve 168 is moved forward, together with the inner sleeve 166, relative to the clamp shaft 172, the right clamp 174 is brought into the fully-closed state, and the left clamp 176 is brought into the half-open state. The distal end of the wire W is thereby held by the right clamp 174 and the clamp shaft 172. When the distal end of the wire W being held is detected, the twisting motor 140 stops.

(Pull-Back Process)

When the feeding motor 50 rotates in reverse after the distal end holding process has finished, the wire feeding mechanism 38 pulls back the wire W wound around the rebars R. The winding diameter of the wire W around the rebars R is thereby reduced since the distal end of the wire W is held by the right clamp 174 and the clamp shaft 172. When the pull-back of the wire W is completed, the feeding motor 50 stops.

(Proximal Portion Holding Process)

When the twisting motor 140 rotates forward after the pull-back process has finished, the screw shaft 164 is rotated counterclockwise. At this occasion, the outer sleeve 168 is prohibited by the rotation restrictor 145 from rotating counterclockwise. Thus, the outer sleeve 168 is moved forward, together with the inner sleeve 166, relative to the clamp shaft 172 and the left clamp 176 is brought into the fully-closed state. A proximal portion of the wire W (a portion of the wire W that corresponds to a proximal end of the wire W when the wire W is cut) is thereby held by the left clamp 176 and the clamp shaft 172.

(Cutting Process)

When the twisting motor 140 rotates forward further after the proximal portion holding process has finished, the screw shaft 164 is rotated counterclockwise. At this occasion, the outer sleeve 168 is prohibited by the rotation restrictor 145 from rotating counterclockwise, Thus, the outer sleeve 168 is moved further forward, together with the inner sleeve 166, relative to the clamp shaft 172, and the push plate 170 pushes the upper end of the second lever 134 forward. As a result, the wire W is cut by the fixed cutter 128 and the movable cutter 130. When the cutting of the wire W has been completed, the twisting motor 140 stops.

(Twisting Process)

When the twisting motor 140 rotates forward further after the cutting process has finished, the screw shaft 164 is rotated counterclockwise. At this occasion, the outer sleeve 168 is allowed by the rotation restrictor 145 to rotate counterclockwise, and thus the outer sleeve 168, the inner sleeve 166, the clamp shaft 172, the right clamp 174, and the left clamp 176 are integrally rotated counterclockwise. The wire W wound around the rebars R is thereby twisted. When the twisting of the wire W is completed, the twisting motor 140 stops.

(Initial State Returning Process)

When the twisting motor 140 rotates in reverse after the cutting process or the twisting process has finished, the screw shaft 164 is rotated clockwise. At this occasion, the outer sleeve 168 is prohibited by the rotation restrictor 145 from rotating clockwise. Thus, the outer sleeve 168 is moved rearward, together with the inner sleeve 166, relative to the clamp shaft 172. As a result, the left clamp 176 is brought into the fully-open state through the half-open state, and the right clamp 174 is brought into the fully-open state. Further, the movable cutter 130 is brought into the communicated state. After this, when the clockwise rotation of the outer sleeve 168 is allowed by the rotation restrictor 145, the outer sleeve 168, the inner sleeve 166, the clamp shaft 172, the right clamp 174, and the left clamp 176 are integrally rotated clockwise. When the long fin 198*b* contacts the lower stopper 204, the rotation of the outer sleeve 168 is prohibited again and the outer sleeve 168 is moved rearward, together with the inner sleeve 166, relative to the clamp shaft 172. When the wire twisting mechanism 46 having returned to the initial state is detected, the twisting motor 140 stops.

The rebar tying machine 2 according to the present embodiment is configured capable of performing a single-winding tying operation in which the wire W is wound around the rebars once and the single wire W is twisted, and is further configured capable of performing a double-winding tying operation in which the wire W is wound around the rebars R twice and the two wires W are twisted simultaneously.

(Single-Winding Tying Operation)

Figure 25:
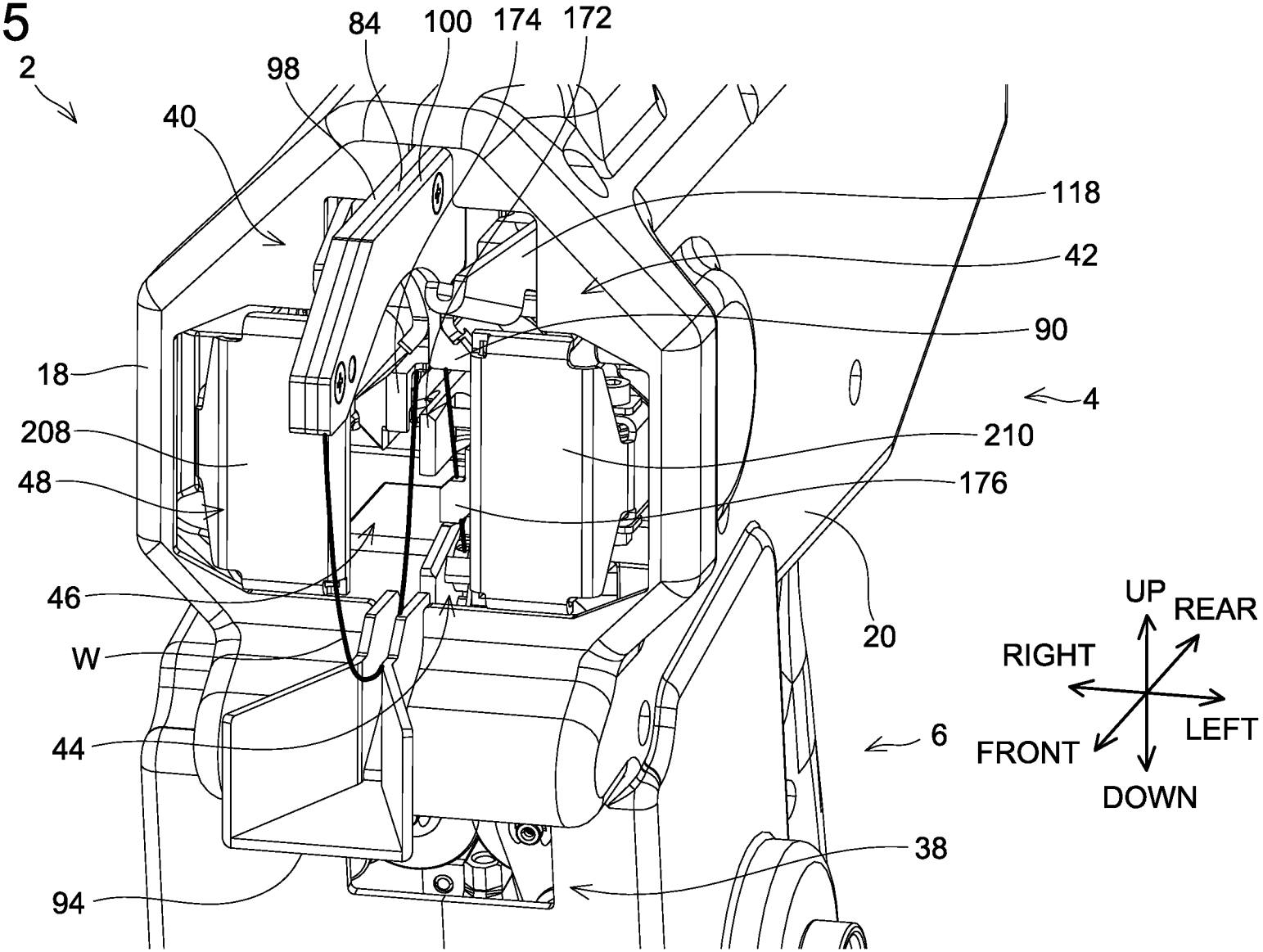
FIG. 25 is a perspective view showing how a wire W is wound in the rebar tying machine 2 according to the embodiment.
Figure 26:
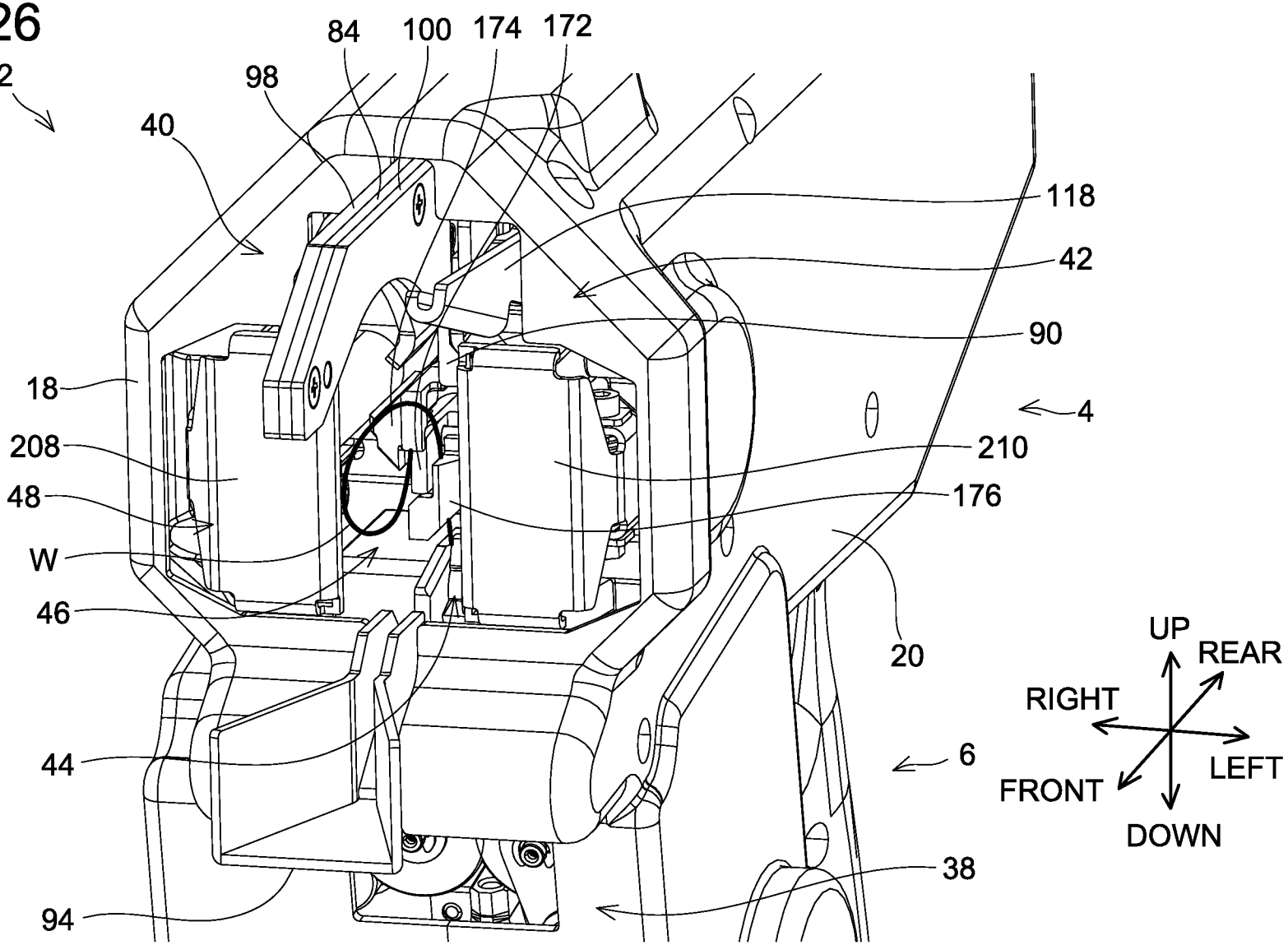
FIG. 26 is a perspective view showing how the wire W is wound in the rebar tying machine 2 according to the embodiment.

For the single-winding, tying operation, the rebar tying machine 2 performs, in sequence, the feeding process, the distal end holding process, the pull-back process, the proximal portion holding process, the cutting process, the twisting process, and the initial state returning process. In this case, the wire W is fed out by the wire feeding mechanism 38 as shown in FIG. 25, and after that, the distal end of the wire W is held by the wire twisting mechanism 46, the wire W is pulled back by the wire feeding mechanism 38, the proximal portion of the wire W is also held by the wire twisting mechanism 46, and the wire W is cut by the wire cutting mechanism 44 as shown in FIG. 26. Thereafter, the wire W is twisted by the wire twisting mechanism 46.

(Double-Winding Tying Operation)

Figure 27:
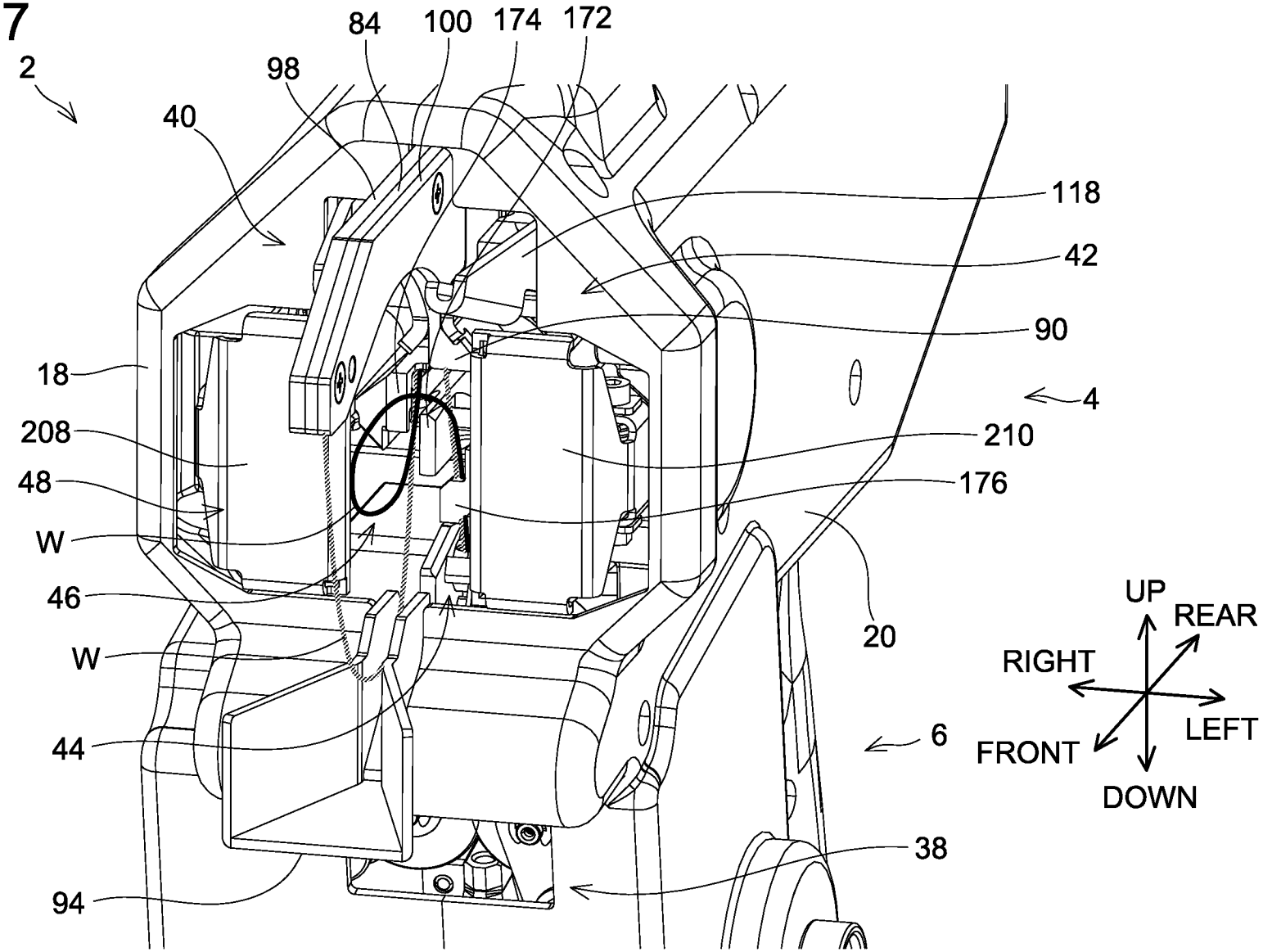
FIG. 27 is a perspective view showing how the wire W is wound in the rebar tying machine 2 according to the embodiment.
Figure 28:
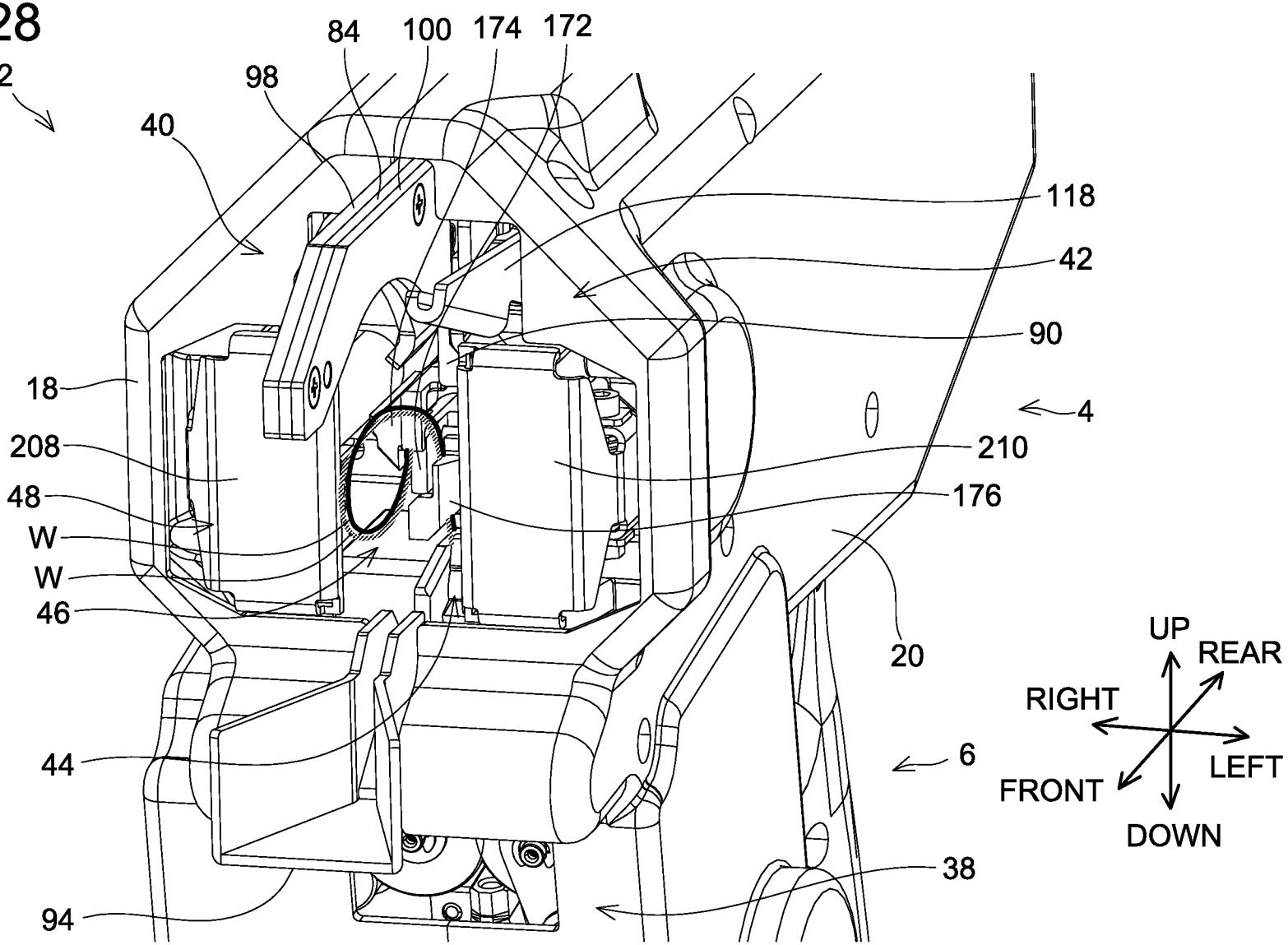
FIG. 28 is a perspective view showing how the wire W is wound in the rebar lying machine 2 according to the embodiment.

For the double-winding tying operation, the rebar tying machine 2 performs the feeding process, the distal end holding process, the pull-back process, the proximal portion holding process, and the cutting process in sequence, and then performs the initial state returning process. In this case, the wire W for a first winding is fed out by the wire feeding mechanism 38 as shown in FIG. 25, and after that, the distal end of the wire W for first winding is held by the wire twisting mechanism 46, the wire W for first winding is pulled back by the wire feeding mechanism 38, the proximal portion of the wire W for first winding is also held by the wire twisting mechanism 46, and the wire W for first winding is cut by the wire cutting mechanism 44 as shown in FIG. 26. Then, the wire twisting mechanism 46 releases the distal and proximal ends of the wire W for first winding. After this, the rebar tying machine 2 performs, in sequence, the feeding process, the distal end holding, process, the pull-back process, the proximal portion holding process, the cutting process, the twisting process, and the initial state returning process. In this case, the wire W for second winding is fed out by the wire feeding mechanism 38 as shown in FIG. 27, and after that, the distal end of the wire W for first winding and the distal end of the wire W for second winding are held by the wire twisting mechanism 46, the wire W for second winding is pulled back by the wire feeding mechanism 38, the proximal end of the wire W for first winding and the proximal portion of the wire W for second winding are held by the wire twisting mechanism 46, and the wire W for second winding is cut by the wire cutting mechanism 44 as shown in FIG. 28. Then, the wire W for first winding and the wire W for second winding are twisted by the wire twisting mechanism 46.

It can be considered that the wire W for first winding is twisted before the wire W for second winding is wound, and then the wire W for second winding is wound and twisted. However, this configuration makes working time longer since the twisting process has to be performed twice. Further, with this configuration, the wire W for second winding may contact the twisted portion of the wire W for first winding when fed out, and thus the wire W for second winding may not be guided around the rebars R and/or the wire W for second winding may climb onto the twisted portion of the wire W for first winding when twisted, as a result of which the wire W for second winding may not be brought into tight contact with the rebars R. To the contrary, in the double-winding tying operation, the rebar tying machine 2 according to the present embodiment winds the wire W for second winding around the rebars R before twisting the wire W for first winding and then twists the wire W for first winding and the wire W for second winding simultaneously. This configuration can reduce working time. Further, this configuration can also prevent the twisted portion of the wire W for first winding from interfering with the wire W for second winding upon winding and twisting the same.

(Circuit Configuration of Control Circuit Board 36)

Figure 29:
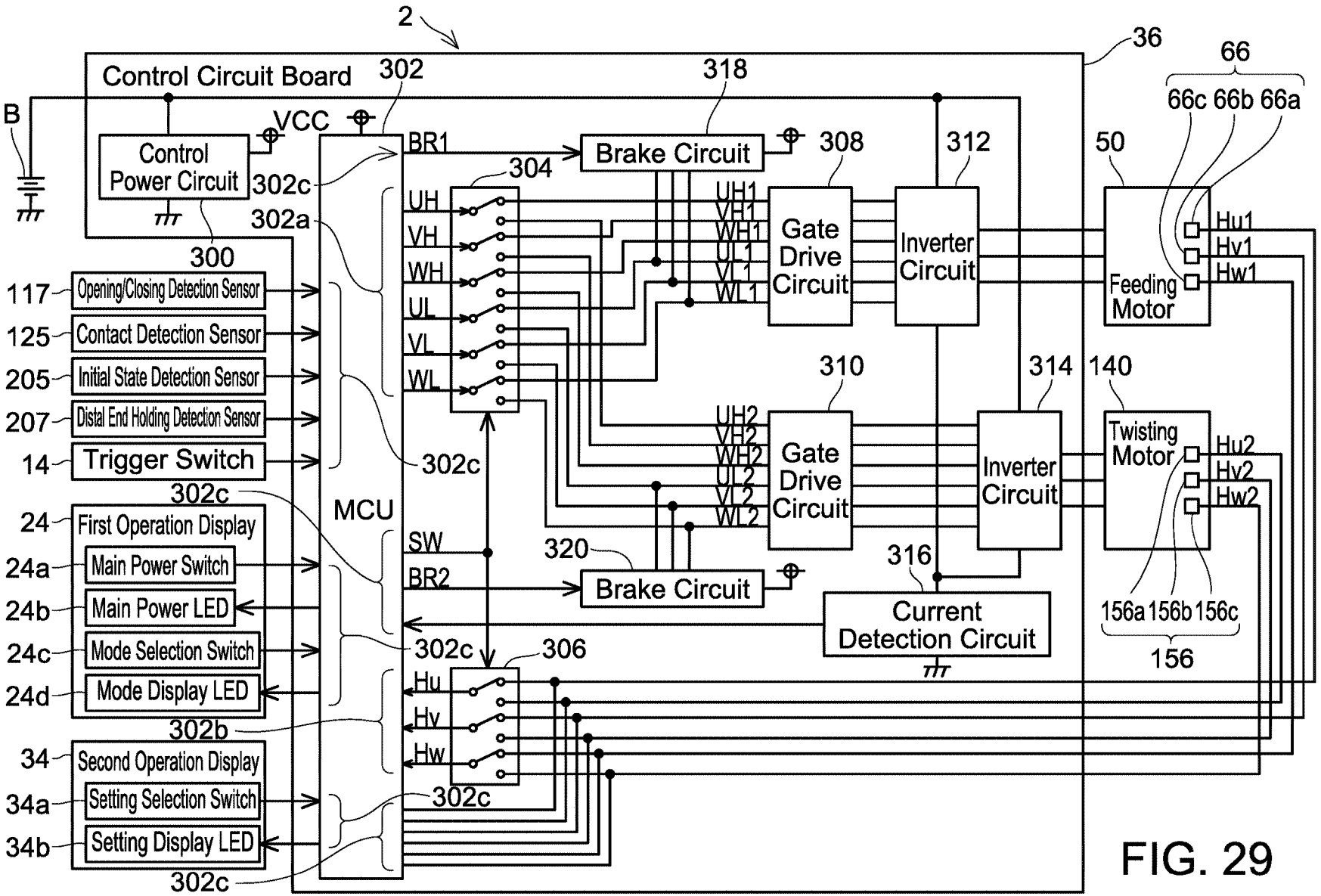
FIG. 29 shows a circuit configuration of a control circuit board 36 of the rebar tying machine 2 according to the embodiment.

As shown in FIG. 29, the control circuit board 36 includes a control power circuit 300, an MCU (Micro Control Unit) 302, a motor-control-signal output-destination switching circuit 304, a motor-rotation-signal input-source switching circuit 306, gate drive circuits 308 and 310, inverter circuits 312 and 314, a current detection circuit 316, brake circuits 31$ and 320, etc.

The control power circuit 300 is configured to adjust electric power supplied from the battery pack B to a predetermined voltage, and supply the electric power to the MCU 302, the brake circuits 318 and 320, etc.

The inverter circuit 312 comprises a plurality of upper switching elements (not shown) connected in parallel between a positive terminal-side potential of the battery pack B and the coils 56 of the feeding motor 50, and a plurality of lower switching elements (not shown) connected in parallel between the coils 56 of the feeding motor 50 and the current detection circuit 316. The gate drive circuit 308 is configured to control the feeding motor 50 by switching the upper and lower switching elements of the inverter circuit 312 between a conduction state and a non-conduction state according to motor control signals UH1, VH1, WH1, UL1, VL1, and WL1. When the gate drive circuit 308 switches all of the upper and lower switching elements to the non-conduction state while the feeding motor 50 is rotating, the power supply to the feeding motor 50 is cut off, and thus the feeding motor 50 stops after keeping rotating by inertia for a while. When the gate drive circuit 308 switches the upper switching elements to the non-conduction state and switches the lower switching elements to the conduction state while the feeding motor 50 is rotating, a so-called short-circuit brake is imposed on the feeding motor 50, and thus the feeding motor 50 stops rotating immediately.

Similarly, the inverter circuit 314 comprises a plurality of upper switching elements (not shown) connected in parallel between the positive terminal-side potential of the battery pack B and the coils 146 of the twisting motor 140, and a plurality of lower switching elements (not shown) connected in parallel between the coils 146 of the twisting motor 140 and the current detection circuit 316. The gate drive circuit 310 is configured to control the twisting motor 140 by switching the upper and lower switching elements of the inverter circuit 314 between a conduction state and a non-conduction state according to motor control signals UH2, VH2, WH2, UL2, VL2, and WL2. When the gate drive circuit 310 switches all of the upper and lower switching elements to the non-conduction state while the twisting motor 140 is rotating, the power supply to the twisting motor 140 is cut off, and thus the twisting motor 140 stops after keeping rotating by inertia for a while. When the gate drive circuit 310 switches the upper switching elements to the non-conduction state and switches the lower switching elements to the conduction state while the twisting motor 140 is rotating, a so-called short-circuit brake is imposed on the twisting motor 140, and thus the twisting motor 140 stops rotating immediately.

The current detection circuit 316 is disposed between a negative terminal-side potential of the battery pack B and the inverter circuits 312 and 314. The current detection circuit 316 detects magnitudes of currents flowing through the inverter circuits 312 and 314. The current detection circuit 316 outputs the detected current values to the MCU 302.

The MCU 302 comprises a motor-control-signal output port 302*a*, a motor-rotation-signal input port 302*b*, and general-purpose input-output ports 302*c*. The motor-control-signal output port 302*a* is for output of motor control signals UH, VH, WH, UL, VL, and WL to a brushless motor and are capable of processing signals faster than the general-purpose input-output ports 302*c*. The motor-rotation-signal input port 302*b* is for input of Hall sensor signals Hu, Hv, and Hw from the brushless motor and are capable of processing signals faster than the general-purpose input-output ports 302*c*. The trigger switch 14; the opening/closing detection sensor 117; the contact detection sensor 125; the initial state detection sensor 205; the distal end holding detection sensor 207; the main power switch 24*a*, the main power LED 24*b*, the mode selection switch 24*c*, and the mode display LED 24*d* of the first operation display 24; and the setting selection switch 34*a* and the setting display LED 34*b* of the second operation display 34 are all connected to the general-purpose input-output ports 302*c* of the MCU 302.

The motor-control-signal output port 302*a* of the MCU 302 is connected to the motor-control-signal output-destination switching circuit 304. The motor-control-signal output-destination switching circuit 304 switches output destinations of the motor control signals UH, VH, WH, UL, VL, and WL outputted from the motor-control-signal output port 302*a* between the gate drive circuit 308 and the gate drive circuit 310 according to a switching signal SW outputted from the general-purpose input-output port 302*c* of the MCU 302.

The brake circuit 318 is connected to signal lines for the motor control signals UL1, VL1, and WL1 outputted from the motor-control-signal output-destination switching circuit 304 to the gate drive circuit 308. The brake circuit 318 imposes the short-circuit brake on the feeding motor 50 according to a brake signal BR1 outputted from the general-purpose input-output port 302*c* of the MCU 302.

Similarly, the brake circuit 320 is connected to signal lines for the motor control signals UE2, VL2, and WL2 outputted from the motor-control-signal output-destination switching circuit 304 to the gate drive circuit 310. The brake circuit 320 imposes the short-circuit brake on the twisting motor 140 according to a brake signal BR2 outputted from the general-purpose input-output port 302*c* of the MCU 302.

The Hall sensor 66 of the feeding motor 50 and the Hall sensor 156 of the twisting motor 140 are connected to the motor-rotation-signal input-source switching circuit 306. The motor-rotation-signal input-source switching circuit 306 is connected to the motor-rotation-signal input port 302*b* of the MCU 302. The motor-rotation-signal input-source switching circuit 306 inputs either one of a group of Hall sensor signals Hu1, Hv1, and Hw1 from the feeding motor 50 and a group of Hall sensor signals Hu2, Hv2, and Hw2 from the twisting motor 140 to the motor-rotation-signal input port 302*b* of the MCU 302 according to the switching signal SW outputted from the MCU 302.

The Hall sensor 66 of the feeding motor 50 and the Hall sensor 156 of the twisting motor 140 are also connected to the general-purpose input-output port 302*c* of the MCU 302. The MCU 302 can monitor the group of Hall sensor signals Hu1, Hv1, and Hw1 from the feeding motor 50 or the group of Hall sensor signals Hu2, Hv2, and Hw2 from the twisting motor 140 inputted to the general-purpose input-output port 302*c*.

(Process Performed by MCU 302)

Figure 30:
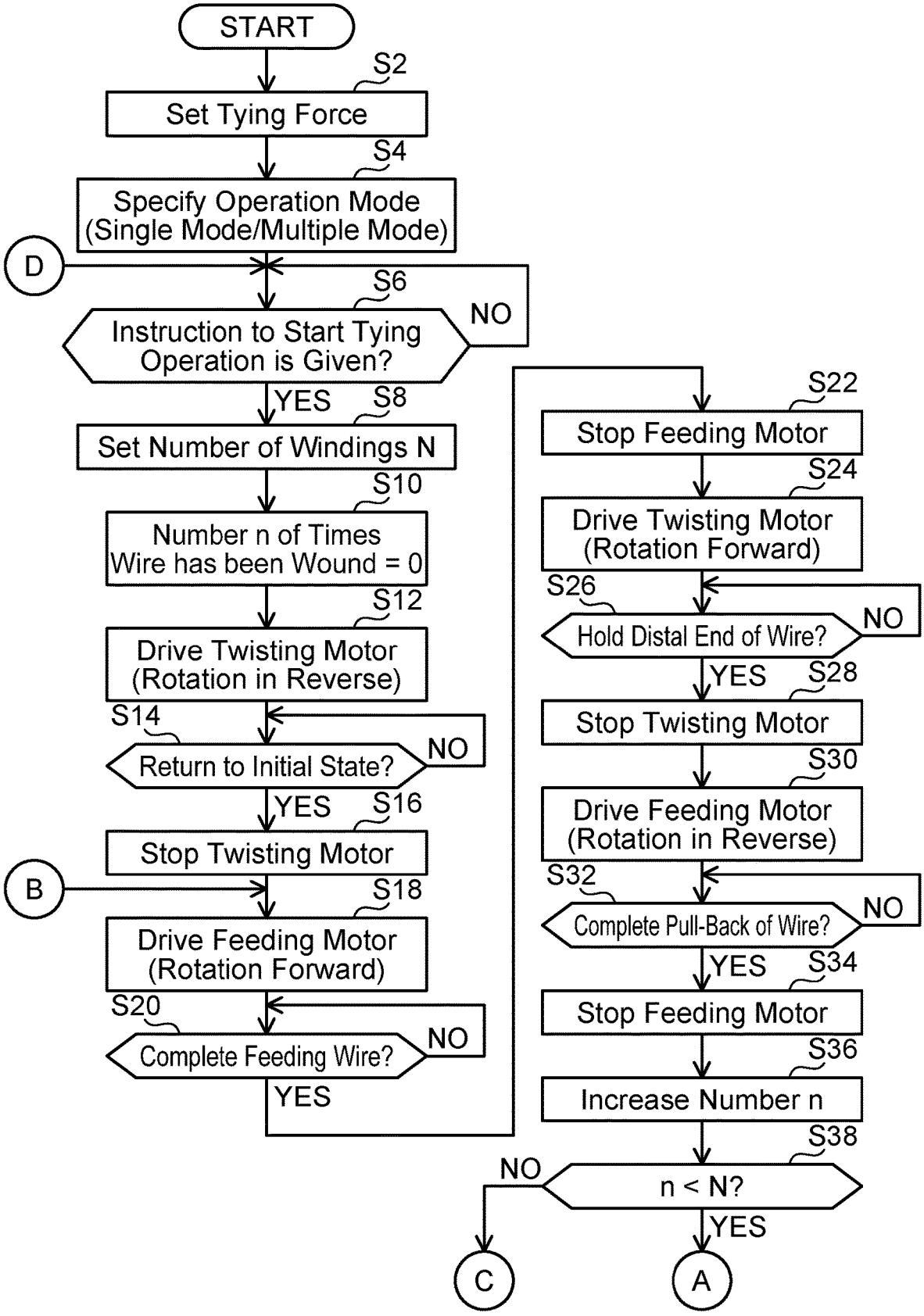
FIG. 30 is a flowchart of a process performed by an MCU 302 of the rebar tying machine 2 according to the embodiment.
Figure 31:
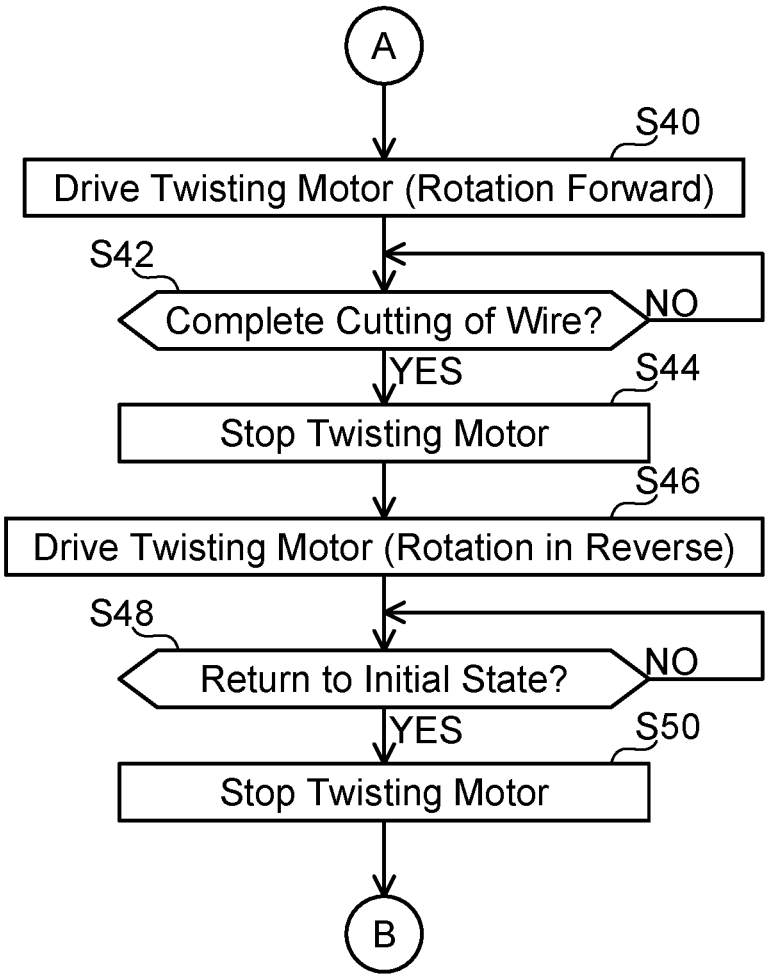
FIG. 31 is a flowchart of the process performed by the MCU 302 of the rebar tying machine 2 according to the embodiment.
Figure 32:
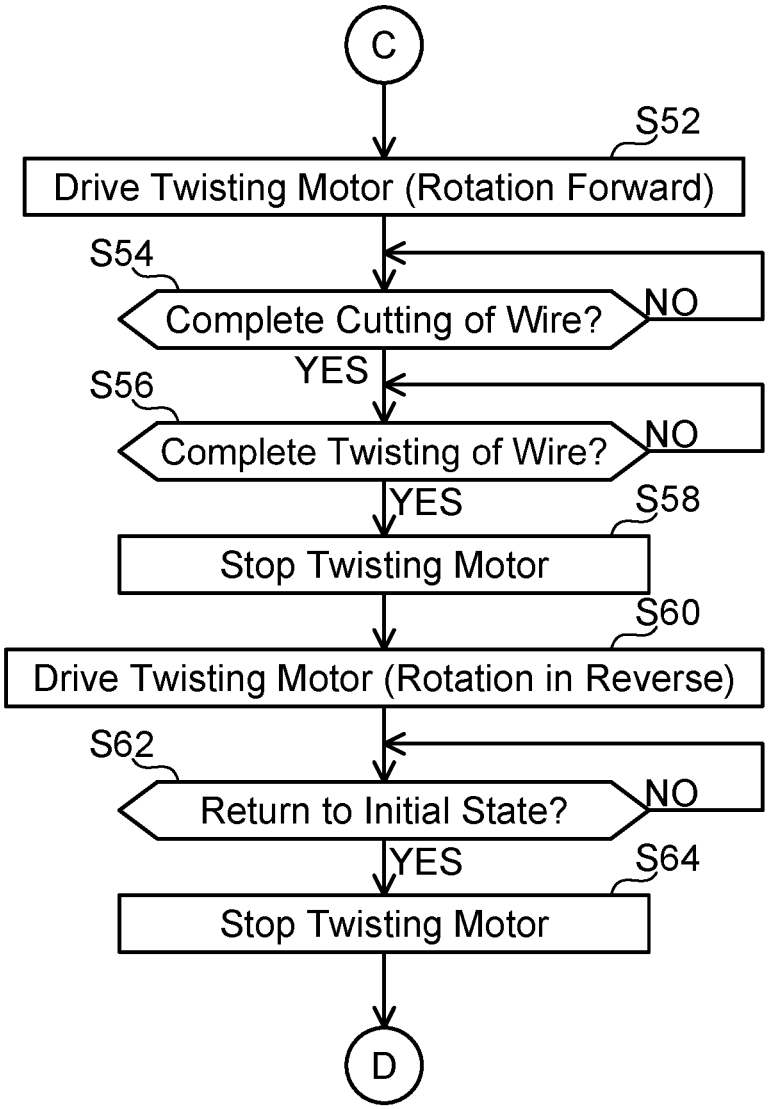
FIG. 32 is a flowchart of the process performed by the MCU 302 of the rebar tying machine 2 according to the embodiment.

When the main power is turned on, the MCU 302 performs a process shown in FIGS. 30 to 32.

As shown in FIG. 30, in S2, the MCU 302 obtains a tying force of the wire W set at the second operation display 34.

In S4, the MCU 302 specifies which of the single mode and the multiple mode is set as the operation mode at the first operation display 24.

In S6, the MCU 302 waits until an instruction to start a tying operation is given. When the operation mode is the single mode, the MCU 302 determines that the instruction to start a tying operation is given in response to the trigger switch 14 being switched from OFF to ON. When the operation mode is the multiple mode, the MCU 302 determines that the instruction to start a tying operation is given in response to the trigger switch 14 being ON and the contact detection sensor 125 being switched from OFF to ON. When the instruction to start a tying operation is given (YES in S6), the process proceeds to S8.

In S8, the MCU 302 sets the number of windings N of the wire W according to the set tying force of the wire W. In the present embodiment, the MCU 302 sets the number of windings N of the wire W as 1 when the set tying force of the wire W is small, that is, when the tying force of the wire W is set at any one of levels 1 to 3, while the MCU 302 sets the number of windings N of the wire W as 2 when the set tying force of the wire W is large, that is, when the tying force of the wire W is set at any one of levels 4 to 6.

In S10, the MCU 302 sets the number n of times the wire W has been wound as zero.

In S12, the MCU 302 drives the twisting motor 140 such that it rotates in reverse. The initial state returning process is thereby started.

In S14, the MCU 302 waits until the wire twisting mechanism 46 returns to the initial state. The MCU 302 determines that the wire twisting mechanism 46 has returned to the initial state in response to the initial state detection sensor 205 being turned on and the current flowing through the twisting motor 140 reaching a first predetermined current value. When the wire twisting mechanism 46 has returned to the initial state (YES in S14), the process proceeds to S16.

In S16, the MCU 302 stops the twisting motor 140. The initial state returning process is thereby finished.

In S18, the MCU 302 drives the feeding motor 50 such that it rotates forward. The feeding process is thereby started.

In S20, the MCU 302 waits until the feeding of the wire W is completed. The MCU 302 determines that the feeding of the wire W is completed when the feeding motor 50 has rotated predetermined times since the feeding motor 50 started rotating in S18. How many times the feeding motor 50 has rotated can be identified based on a detection signal of the Hall sensor 66. When the feeding motor 50 has rotated predetermined times (YES in S20), the process proceeds to S22.

In S22, the MCU 302 stops the feeding motor 50. The feeding process is thereby finished.

In S24, the MCU 302 drives the twisting motor 140 such that it rotates forward. The distal end holding process is thereby started.

In S26, the MCU 302 waits until the distal end of the wire W is held. The MCU 302 determines that the distal end of the wire W has been held in response to the distal end holding detection sensor 207 being turned on. When the distal end of the wire W is held (YES in S26), the process proceeds to S28.

In S28, the MCU 302 stops the twisting motor 140. The distal end holding process is thereby finished.

In S30, the MCU 302 drives the feeding motor 50 such that it rotates in reverse. The pull-back process is thereby started.

In S32, the MCU 302 waits until the pull-back of the wire W is completed. The MCU 302 determines that the pull-back of the wire W has been completed in response to the current flowing through the feeding motor 50 reaching a second predetermined current value. The second predetermined current value is larger than the first predetermined current value. When the pull-back of the wire W has been completed (YES in S32), the process proceeds to S34.

In S34, the MCU 302 stops the feeding motor 50. The pull-back process is thereby finished.

In S36, the MCU 302 increases the number n of times the wire W has been wound by one.

In S38, the MCU 302 determines whether the number n of times the wire W has been wound is smaller than the number N of windings set in S8 or not. When the number n of times the wire W has been wound is smaller than the number N of windings (YES in S38), the process proceeds to S40.

As shown in FIG. 31, in S40, the MCU 302 drives the twisting motor 140 such that it rotates forward. The cutting process is thereby started after the proximal portion holding process has been performed.

In S42, the MCU 302 waits until the cutting of the wire W is completed. The MCU 302 determines that the cutting of the wire W has been completed in response to the current flowing through the twisting motor 140 reaching a third predetermined current value. The third predetermined current value is larger than the first and second predetermined current values. When the cutting of the wire W has been completed (YES in S42), the process proceeds to S44.

In S44, the MCU 302 stops the twisting motor 140. The cutting process is thereby finished.

In S46, the MCU 302 drives the twisting motor 140 such that rotates in reverse. The initial state returning process is thereby started.

In S48, the MCU 302 waits until the wire twisting mechanism 46 returns to the initial state. The MCU 302 determines that the wire twisting mechanism 46 has returned to the initial state in response to the initial state detection sensor 205 being turned on. When the wire twisting mechanism 46 has returned, to the initial state (YES in S48), the process proceeds to S50.

In S50, the MCU 302 stops the twisting motor 140. The initial state returning process is thereby finished. After S50, the process returns to S18 as shown in FIG. 30.

When the number n of times the wire W has been wound is equal to or larger than the number N of windings in S38 (NO in S38), the process proceeds to S52.

As shown in FIG. 32, in S52, the MCU 302 drives the twisting motor 140 to rotate forward. The cutting process is thereby started after the proximal portion holding process has been performed.

In S54, the MCU 302 waits until the cutting of the wire W is completed. The MCU 302 determines that the cutting of the wire W has been completed in response to the current flowing through the twisting motor 140 reaching the third predetermined current value. When the cutting of the wire W has been completed (YES in S54), the process proceeds to S56. The cutting process is thereby finished, and then the twisting process is started.

In S56, the MCU 302 waits until the twisting of the wire W is completed. The MCU 302 determines that the twisting of the wire W has been completed in response to the current flowing through the twisting motor 140 dropping after S54 and thereafter reaching a fourth predetermined current value. The fourth predetermined current value is larger than the first and second predetermined current values and is smaller than the third predetermined current value. When the twisting of the wire W has been completed (YES in S56), the process proceeds to S58.

In S58, the MCU 302 stops the twisting motor140. The twisting process is thereby finished.

In S60, the MCU 302 drives the twisting motor 140 such that it rotates in reverse. The initial state returning process is thereby started.

In S62, the MCU 302 waits until the wire twisting mechanism 46 returns to the initial state. The MCU 302 determines that the wire twisting mechanism 46 has returned to the initial state in response to the initial state detection sensor 205 being turned on. When the wire twisting mechanism 46 has returned to the initial state (YES in S62), the process proceeds to S64.

In S64, the MCU 302 stops the twisting motor 140. The initial state returning process is thereby finished. After S64, the process returns to S6 as shown in FIG. 30.

(Variants)

In the rebar tying machine 2, the number of windings of the wire W as well as the tying force of the wire W may be settable by the user. For example, the second operation display 34 shown in FIG. 1 may comprise a tying three setting switch (not shown) and a number of windings setting switch (not shown), instead of the tying force increasing switch 34*c* and the tying force reducing switch 34*d*. In this case, the setting display LED 34*b* is normally off, while it is turned on when the number of windings setting switch is manipulated and displays a recommended setting value for the tying force of the wire W according to the currently set number of windings of the wire W. When the number of windings setting switch is manipulated in this state, the setting value for the number of windings of the wire W is switched between 1 and 2, and the recommended setting value for the tying force of the wire W displayed by the setting display LED 34*b* is also switched accordingly. In the case where the number of windings of the wire W is set as 1, the recommended setting value for the tying force of the wire W is level 1. When the tying three setting switch is manipulated in such a slate, the current setting value for the tying force of the wire W is changed to the recommended setting value and this recommended setting value for the tying force of the wire W is displayed at the setting display LED 34*b*. Every time the tying force setting switch is manipulated thereafter, the setting value for tying force of the wire W is increased by one level. When the tying three setting switch is manipulated with the setting value for tying three of the wire W at level 6, the setting value for tying force of the wire W returns to level 1. In the case where the number of windings of the wire W is set as 2, the recommended setting value for the tying force of the wire W is level 6. When the tying force setting switch is manipulated, the current setting value for the tying force of the wire W is changed to the recommended setting value and this recommended setting value for the tying force of the wire W is displayed at the setting display LED 34*b*. Every time the tying force setting switch is manipulated in such a state, the setting value for tying force of the wire W is reduced by one level. When the tying force setting switch is manipulated with the setting value for tying force of the wire W at level 1, the setting value for tying force of the wire W returns to level 6. When a predetermined time elapses without any manipulation performed on the tying force setting switch nor the number of windings setting switch in the state where the setting display LED 34*b* displays the current setting value for the tying force of the wire W, the setting display LED 34*b* is turned off. In the case where the number of windings of the wire W is also settable by the user, the MCU 302 sets the number of windings of the wire W in the second operation display 34 as the number N of windings of the wire W in S8 of FIG. 30, and thus the rebar tying machine 2 can perform the tying operation according to the set number of windings of the wire W.

In the embodiment and variant described above, the rebar tying machine 2 may be configured to perform a tying operation in which the wire W is wound around the rebars R three times or more and the three or more wires W are twisted simultaneously. In this case, the holding of the distal end of the wire W, the pull-back of the wire W, and the cutting of the wire W may be performed every time the wire W is wound around the rebars R.

In the embodiment and variant described above, the MCU 302 may determine whether the rotational speed of the twisting motor 140 has reduced to a first predetermined rotational speed or not in S14 of FIG. 30, instead of determining whether the current flowing through the twisting motor 140 has reached the first predetermined current value. The rotational speed of the twisting motor 140 can be identified from a detection signal of the Hall sensor 156. Similarly, the MCU 302 may determine whether the rotational speed of the feeding motor 50 has reduced to a second predetermined rotational speed or not in S32 of FIG. 30, instead of determining whether the current flowing through the feeding motor 50 has reached the second predetermined current value or not. The rotational speed of the feeding motor 50 can be identified from a detection signal of the Hall sensor 66. Similarly, the MCU 302 may determine whether the rotational speed of the twisting motor 140 has reduced to a third predetermined rotational speed or not in S42 of FIG. 31 and S54 of FIG. 32, instead of determining whether the current flowing through the twisting motor 140 has reached the third predetermined current value or not. Similarly, the MCU 302 may determine whether the rotational speed of the twisting motor 140 has reduced to a fourth predetermined rotational speed or not in S56 of FIG. 32, instead of determining whether the current flowing through the twisting motor 140 has reached the fourth predetermined current value or not.

As described, in one or more embodiments, the rebar tying machine 2 is configured to perform: a winding process in which the wire W is fed around rebars R, a vicinity of a distal end of the wire W is grasped, the wire W is pulled back, and the wire W is cut; and a twisting process in which the wire W is twisted. When instructed to tie the rebars R by the user, the rebar tying machine 2 is configured capable of performing the multiple-winding tying operation in which the twisting process is performed after the winding process has been performed multiple times.

With the above configuration, the wire W is fed out around the rebars R and then the wire W is pulled back and cut in the winding process, and thus the wire W wound around the rebars R has a reduced winding diameter. When this wound wire W with the reduced winding diameter is twisted in the twisting process, a twisted portion of the wire W is less likely to be non-uniform and variations in the tying force of the wire W at the end of the twisting process can be reduced. Further, an amount of the wire W consumed in one tying operation can be reduced.

In one or more embodiments, when instructed to tie the rebars R by the user, the rebar tying machine 2 is configured capable of performing the single-winding tying operation in which the twisting process is performed after the winding process has been performed once.

With the above configuration, the wire W can be twisted after wound around the rebars R once or the wire W can be twisted after wound around the rebars R multiple times depending on the situation.

In one or more embodiments, in the rebar tying machine 2, the wire W is wound around the rebars R once when the winding process is performed once.

With a configuration in which the wire W is fed and wound around the rebars R multiple times and then it is pulled back and cut, the winding diameter of the wire W might become non-uniform. However, in the configuration described above, the wire W is pulled back and cut each time the wire W is fed and wound around the rebars R, and thus the winding diameter of the wire W can be uniformized.

In one or more embodiments, in the rebar tying machine 2, the tying force of the wire W in the twisting process is settable by the user. The number of times the winding process is performed is determined in accordance with the set tying force.

The larger a required tying force of the wire W is, the more times the wire W needs to be wound. With the configuration described above, how many times the wire W should be wound can be automatically determined according to the tying force set by the user.

In one or more embodiments, in the rebar tying machine 2, the number of windings of the wire W in the winding process is settable by the user. The number of times the winding process is performed is determined in accordance with the set number of windings.

With the configuration described above, the wire W can be wound according to the number of windings the user desires.

In one or more embodiments, the rebar tying machine 2 comprises the wire cutting mechanism 44 (an example of the cutting mechanism) configured to cut the wire W; and the twisting motor 140 (an example of the motor) configured to drive the wire cutting mechanism 44. The rebar tying machine 2 is configured to determine whether the wire W has been cut based on a load of the twisting motor 140 in the winding process.

In the configuration described above, the load of the twisting motor 140 increases when the wire cutting mechanism 44 cuts the wire W, while the load of the twisting motor 140 decreases after the wire cutting mechanism 44 has cut the wire W. Whether the wire W has been cut or not can be detected based on such a change in the load of the twisting motor 140, and thus there is no need to use a special sensor to detect it.

In one or more embodiments, the rebar tying machine 2 is configured to determine that the wire W has been cut when the rotational speed of the twisting motor 140 or the current flowing through the twisting motor 140 satisfies a predetermined condition in the winding process.

As the load of the twisting motor 140 increases, the rotational speed of the twisting motor 140 decreases and the current flowing through the twisting motor 140 increases. With the configuration described above, whether the wire W has been cut or not can be determined using the Hall sensor 156 configured to detect the rotational speed of the twisting motor 140 or the current detection circuit 316 configured to detect the current flowing through the twisting motor 140.

In one or more embodiments, the rebar tying machine 2 comprises the wire feeding mechanism 38 (an example of the feeding mechanism) configured to feed the wire W around rebars R, the wire twisting mechanism 46 (an example of the twisting mechanism) configured to twist the wire W, the control circuit board 36 (an example of the controller) configured to control the wire feeding mechanism 38 and the wire twisting mechanism 46, and the second operation display 34 (an example of the setting member) with which the user sets a tying force of the wire W. The control circuit board 36 is configured to determine the number of windings of the wire W in accordance with the set tying force.

The larger a required tying force of the wire W is, the more times the wire W needs to be wound. With the configuration described above, how many times the wire W should be wound can be automatically determined according to the tying force set by the user.

What is claimed is:

1. A rebar tying machine comprising:

a feeding mechanism comprising a feeding motor and configured to feed a wire around rebars and pull back the wire;

a grasping mechanism comprising a grasping member configured to grasp a distal end portion of the wire after the wire is wound around the rebars;

a cutting mechanism comprising a cutter configured to cut the wire after the wire is grasped by the grasping mechanism;

a twisting mechanism comprising a twisting motor and configured to twist the wire after the wire is cut by the cutting mechanism; and a control unit configured to control the feeding mechanism, the grasping mechanism, the cutting mechanism, and the twisting mechanism to perform, when instructed by a user to operate in a first manner, a winding-cutting process at least twice before performance of a twisting process;

wherein the winding-cutting process includes feeding the wire, around the rebars by the feeding mechanism, grasping the distal end portion of the wire the grasping mechanism, pulling the wire back by the feeding mechanism, and cutting the wire by the cutting mechanism;

wherein the twisting process includes twisting the wire by the twisting mechanism.

2. The rebar tying machine according to claim 1, wherein, when instructed by the user to operate in a second manner, the control unit is configured to control the feeding mechanism, the grasping mechanism, the cutting mechanism and the twisting mechanism to perform a single-winding tying operation in which the twisting process is performed after the winding-cutting process has been performed once.

3. The rebar tying machine according to claim 2, further comprising a setting unit and a motor configured to drive the cutting mechanism, wherein the wire is wound around the rebars once when the winding-cutting process is performed once, the setting unit is configured to set a tying force of the wire in the twisting process or a number of windings of the wire in the winding-cutting process based on an operation from the user, the control unit is configured to determine (i) a number of times the winding-cutting process is performed in accordance with the set tying force or the set number of windings and (ii) that the wire has been cut when a rotational speed of the motor or a current flowing through the motor satisfies a predetermined condition during the winding-cutting process.

4. The rebar tying machine according to claim 1, further comprising a setting unit configured to set a tying force of the wire in the twisting process based on an operation from the user, wherein the control unit is configured to determine a number of times the winding-cutting process is performed in accordance with the set tying force.

5. The rebar tying machine according to claim 1, further comprising a setting unit configured to set a number of windings of the wire in the winding-cutting process based on an operation from the user, wherein the control unit is configured to determine a number of times the winding-cutting process is performed in accordance with the set number of windings.

6. The rebar tying machine according to claim 1, further comprising a motor configured to drive the cutting mechanism, wherein the control unit is configured to determine whether the wire has been cut based on a load of the motor during the winding-cutting process.

7. The rebar tying machine according to claim 6, wherein the control unit is configured to determine that the wire has been cut when a rotational speed of the motor or a current flowing through the motor satisfies a predetermined condition in the winding-cutting process.

8. The rebar tying machine according to claim 1, wherein the control unit is configured to control the grasping mechanism to perform a releasing process in which the grasp of the wire is released by the grasping mechanism between each of the at least two winding-cutting processes.

* * * * *